US012577847B2

(12) United States Patent
Peta et al.

(10) Patent No.: US 12,577,847 B2
(45) Date of Patent: Mar. 17, 2026

(54) ROTATING CONTROL DEVICE

(71) Applicant: SCHLUMBERGER TECHNOLOGY CORPORATION, Sugar Land, TX (US)

(72) Inventors: Madhu Sudhana Rao Peta, Pune (IN); Neha Yashodhan Pise, Pune (IN)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/129,685

(22) PCT Filed: Mar. 11, 2024

(86) PCT No.: PCT/US2024/019343

§ 371 (c)(1),
(2) Date: May 14, 2025

(87) PCT Pub. No.: WO2024/191891

PCT Pub. Date: Sep. 19, 2024

(65) Prior Publication Data

US 2026/0009305 A1 Jan. 8, 2026

(30) Foreign Application Priority Data

Mar. 16, 2023 (IN) ..... 202311017788

(51) Int. Cl.
*E21B 33/08* (2006.01)
*E21B 33/02* (2006.01)

(52) U.S. Cl.
CPC ..... *E21B 33/085* (2013.01); *E21B 33/02* (2013.01)

(58) Field of Classification Search
CPC ..... E21B 33/085; E21B 33/02
See application file for complete search history.

(56) References Cited

U.S. PATENT DOCUMENTS 4,367,795 A * 1/1983 Biffle ..... E21B 33/085 166/88.4
4,455,040 A * 6/1984 Shinn ..... E21B 33/04 285/348
5,279,365 A * 1/1994 Yenulis ..... E21B 34/16 277/332
6,138,774 A * 10/2000 Bourgoyne, Jr. ..... E21B 21/106 175/7
6,470,975 B1 10/2002 Bourgoyne
7,159,669 B2 1/2007 Bourgoyne
7,836,946 B2 * 11/2010 Bailey ..... E21B 36/001 166/84.2
8,286,734 B2 10/2012 Hannegan
(Continued)

OTHER PUBLICATIONS

International Search Report and Written Opinion of International Patent Application No. PCT/US2024/019343 dated on Jul. 11, 2024, 14 pages.

*Primary Examiner* — Neel Girish Patel
(74) *Attorney, Agent, or Firm* — Kyle R. Miiller

(57) ABSTRACT

A rotating control device (RCD) for use during a drilling operation includes a bearing assembly. The bearing assembly includes a bearing body. The bearing assembly also includes a bearing housing positioned around the bearing body. The bearing assembly also includes a load ring positioned around the bearing housing. The load ring includes a tapered surface. The bearing assembly also includes a seal positioned below the load ring.

5 Claims, 24 Drawing Sheets

(56) References Cited

U.S. PATENT DOCUMENTS

| | | | | |
|---|---|---|---|---|
| 8,844,652 | B2 | 9/2014 | Sokol | |
| 12,123,275 | B1 * | 10/2024 | Wang | E21B 33/085 |
| 2002/0121367 | A1 * | 9/2002 | Meek | E21B 33/0415 166/104 |
| 2009/0057012 | A1 * | 3/2009 | Williams | F16C 37/00 175/17 |
| 2009/0057020 | A1 * | 3/2009 | Williams | E21B 33/085 175/195 |
| 2011/0036638 | A1 * | 2/2011 | Sokol | E21B 21/085 175/325.3 |
| 2012/0125633 | A1 * | 5/2012 | Linde | E21B 33/08 166/381 |
| 2012/0177313 | A1 | 7/2012 | Beauchamp | |
| 2015/0159460 | A1 * | 6/2015 | Boyd | E21B 21/08 166/88.1 |
| 2016/0290088 | A1 * | 10/2016 | DeWesee, Jr. | E21B 4/003 |
| 2019/0063176 | A1 * | 2/2019 | Neufeld | E21B 33/085 |
| 2019/0093445 | A1 * | 3/2019 | Kulkarni | E21B 47/10 |
| 2020/0362651 | A1 | 11/2020 | Fraczek | |
| 2021/0340834 | A1 * | 11/2021 | Tran | E21B 33/085 |

* cited by examiner

ROTATING CONTROL DEVICE

CROSS REFERENCE TO RELATED APPLICATION

This application is a National Stage Entry of International Application No. PCT/US2024/019343, filed Mar. 11, 2024, which claims the benefit of and priority to Indian Patent Application No. 202311017788, entitled "ROTATING CONTROL DEVICE," filed Mar. 16, 2023, the disclosure of which is hereby incorporated herein by reference in its entirety.

BACKGROUND

A rotating control device (RCD) is a pressure-control device used during drilling for the purpose of sealing around a drill string while the drill string rotates. The RCD includes a housing having a seal positioned therein. The seal is configured to contact the outer surface of the drill string and the inner surface of the housing to contain hydrocarbons or other wellbore fluids and prevent their release to the atmosphere. However, different wellbores may utilize housings of different sizes (e.g., diameters), and when the diameter of the housing varies, the existing seal may no longer be used.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A rotating control device (RCD) for use during a drilling operation is disclosed. The RCD includes a bearing assembly. The bearing assembly includes a bearing body. The bearing assembly also includes a bearing housing positioned around the bearing body. The bearing assembly also includes a load ring positioned around the bearing housing. The load ring includes a tapered surface. The bearing assembly also includes a seal positioned below the load ring.

In another embodiment, the RCD includes a bearing assembly. The bearing assembly includes a bearing body. The bearing assembly also includes a bearing housing positioned around the bearing body. The bearing assembly also includes a load ring positioned around the bearing housing. The load ring includes a tapered upper surface. The bearing assembly also includes a seal positioned below the load ring. The bearing assembly also includes a landing adapter positioned around the bearing housing, above the bearing housing, or both. The landing adapter is positioned above the seal and the load ring. The landing adapter is coupled to the bearing housing. The landing adapter includes a tapered outer shoulder. The RCD also includes a RCD housing positioned around the bearing assembly and the landing adapter. The RCD housing includes a tapered inner shoulder. The tapered outer shoulder of the landing adapter is configured to land on the tapered inner shoulder of the RCD housing. The RCD also includes a piston extending radially-through an opening in the RCD housing. The piston is configured to move radially-inward to contact the tapered upper surface of the load ring, which pushes the load ring downward and causes the load ring to axially-compress the seal. The seal expands radially in response to being axially-compressed to prevent fluid flow between the bearing housing and the RCD housing as the bearing assembly and the landing adapter rotate with respect to the RCD housing.

A method for assembling a rotating control device (RCD) is also disclosed. The method includes positioning a bearing housing around a bearing body. The method also includes positioning a load ring at least partially around the bearing housing. The load ring includes a tapered surface. The method also includes positioning a seal below the load ring. The method also includes positioning a landing adapter around the bearing housing, above the bearing housing, or both. The method also includes positioning the bearing body, the bearing housing, the load ring, the seal, and the landing adapter within a RCD housing. The method also includes moving a piston radially-inward through an opening in the RCD housing to contact the tapered surface of the load ring, which pushes the load ring downward and causes the load ring to axially-compress the seal. The seal expands radially in response to being axially-compressed to prevent fluid flow between the bearing housing and the RCD housing.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Reference will now be made in detail to specific embodiments illustrated in the accompanying drawings and figures.

In the following detailed description, numerous specific details are set forth in order to provide a thorough understanding of the invention. However, it will be apparent to one of ordinary skill in the art that embodiments may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object could be termed a second object or step, and, similarly, a second object could be termed a first object or step, without departing from the scope of the present disclosure.

The terminology used in the description of the invention herein is for the purpose of describing particular embodiments only and is not intended to be limiting. As used in the description of the invention and the appended claims, the singular forms "a," "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Figure 1:
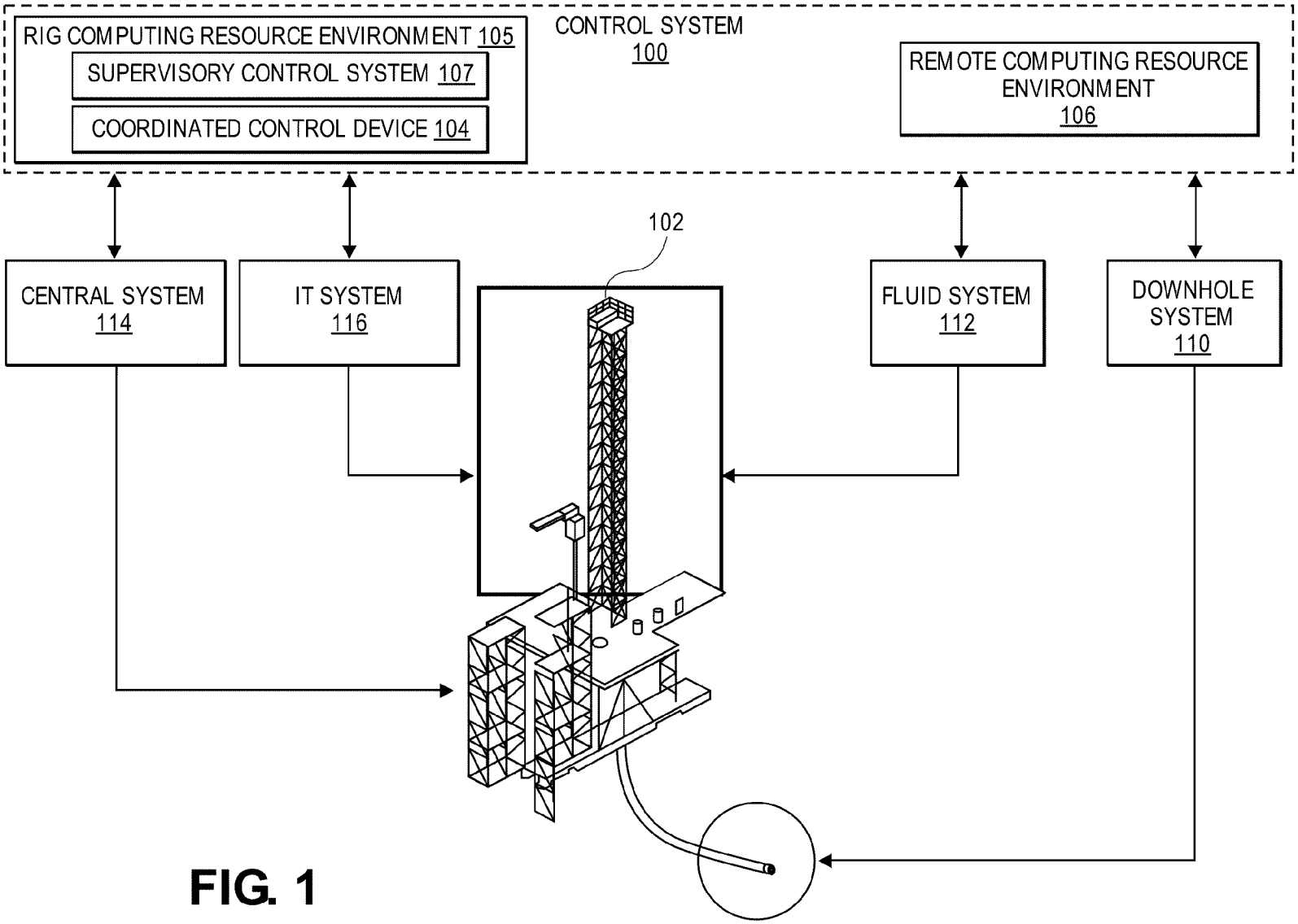
FIG. 1 illustrates a conceptual, schematic view of a control system for a drilling rig, according to an embodiment.

FIG. 1 illustrates a conceptual, schematic view of a control system 100 for a drilling rig 102, according to an embodiment. The control system 100 may include a rig computing resource environment 105, which may be located onsite at the drilling rig 102 and, in some embodiments, may have a coordinated control device 104. The control system 100 may also provide a supervisory control system 107. In some embodiments, the control system 100 may include a remote computing resource environment 106, which may be located offsite from the drilling rig 102.

The remote computing resource environment 106 may include computing resources locating offsite from the drilling rig 102 and accessible over a network. A "cloud" computing environment is one example of a remote computing resource. The cloud computing environment may communicate with the rig computing resource environment 105 via a network connection (e.g., a WAN or LAN connection). In some embodiments, the remote computing resource environment 106 may be at least partially located onsite, e.g., allowing control of various aspects of the drilling rig 102 onsite through the remote computing resource environment 105 (e.g., via mobile devices). Accordingly, "remote" should not be limited to any particular distance away from the drilling rig 102.

Further, the drilling rig 102 may include various systems with different sensors and equipment for performing operations of the drilling rig 102, and may be monitored and controlled via the control system 100, e.g., the rig computing resource environment 105. Additionally, the rig computing resource environment 105 may provide for secured access to rig data to facilitate onsite and offsite user devices monitoring the rig, sending control processes to the rig, and the like.

Various example systems of the drilling rig 102 are depicted in FIG. 1. For example, the drilling rig 102 may include a downhole system 110, a fluid system 112, and a central system 114. These systems 110, 112, 114 may also be examples of "subsystems" of the drilling rig 102, as described herein. In some embodiments, the drilling rig 102 may include an information technology (IT) system 116. The downhole system 110 may include, for example, a bottomhole assembly (BHA), mud motors, sensors, etc. disposed along the drill string, and/or other drilling equipment configured to be deployed into the wellbore. Accordingly, the downhole system 110 may refer to tools disposed in the wellbore, e.g., as part of the drill string used to drill the well.

The fluid system 112 may include, for example, drilling mud, pumps, valves, cement, mud-loading equipment, mud-management equipment, pressure-management equipment, separators, and other fluids equipment. Accordingly, the fluid system 112 may perform fluid operations of the drilling rig 102.

The central system 114 may include a hoisting and rotating platform, top drives, rotary tables, kellys, drawworks, pumps, generators, tubular handling equipment, derricks, masts, substructures, and other suitable equipment. Accordingly, the central system 114 may perform power generation, hoisting, and rotating operations of the drilling rig 102, and serve as a support platform for drilling equipment and staging ground for rig operation, such as connection make up, etc. The IT system 116 may include software, computers, and other IT equipment for implementing IT operations of the drilling rig 102.

The control system 100, e.g., via the coordinated control device 104 of the rig computing resource environment 105, may monitor sensors from multiple systems of the drilling rig 102 and provide control commands to multiple systems of the drilling rig 102, such that sensor data from multiple systems may be used to provide control commands to the different systems of the drilling rig 102. For example, the system 100 may collect temporally and depth aligned surface data and downhole data from the drilling rig 102 and store the collected data for access onsite at the drilling rig 102 or offsite via the rig computing resource environment 105. Thus, the system 100 may provide monitoring capability. Additionally, the control system 100 may include supervisory control via the supervisory control system 107.

In some embodiments, one or more of the downhole system 110, fluid system 112, and/or central system 114 may be manufactured and/or operated by different vendors. In such an embodiment, certain systems may not be capable of unified control (e.g., due to different protocols, restrictions on control permissions, safety concerns for different control systems, etc.). An embodiment of the control system 100 that is unified, may, however, provide control over the drilling rig 102 and its related systems (e.g., the downhole system 110, fluid system 112, and/or central system 114, etc.). Further, the downhole system 110 may include one or a plurality of downhole systems. Likewise, fluid system 112, and central system 114 may contain one or a plurality of fluid systems and central systems, respectively.

In addition, the coordinated control device 104 may interact with the user device(s) (e.g., human-machine interface(s)) 118, 120. For example, the coordinated control device 104 may receive commands from the user devices 118, 120 and may execute the commands using two or more of the rig systems 110, 112, 114, e.g., such that the operation of the two or more rig systems 110, 112, 114 act in concert and/or off-design conditions in the rig systems 110, 112, 114 may be avoided.

Figure 2:
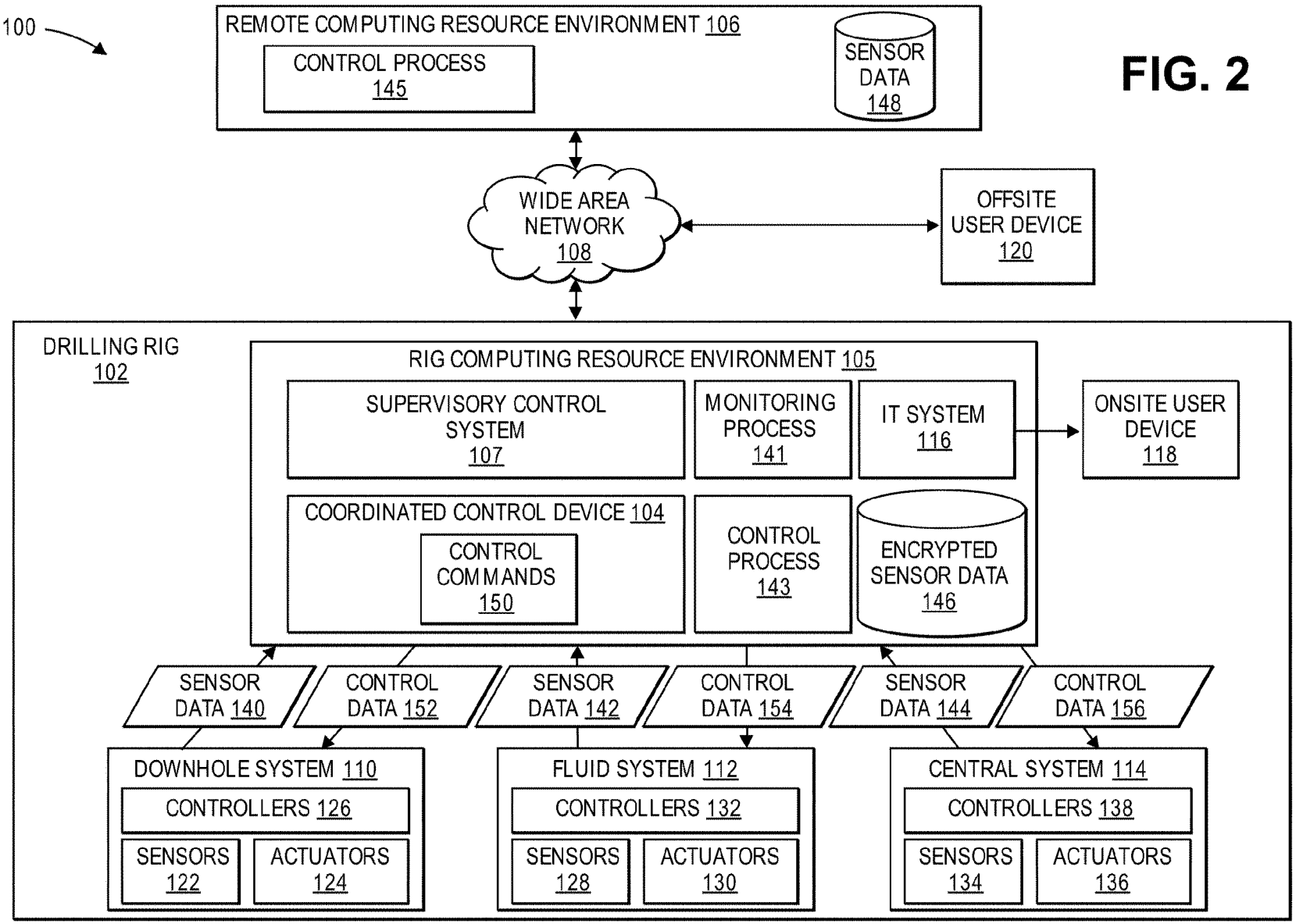
FIG. 2 illustrates a conceptual, schematic view of the control system, according to an embodiment.

FIG. 2 illustrates a conceptual, schematic view of the control system 100, according to an embodiment. The rig computing resource environment 105 may communicate with offsite devices and systems using a network 108 (e.g., a wide area network (WAN) such as the internet). Further, the rig computing resource environment 105 may communicate with the remote computing resource environment 106 via the network 108. FIG. 2 also depicts the aforementioned example systems of the drilling rig 102, such as the downhole system 110, the fluid system 112, the central system 114, and the IT system 116. In some embodiments, one or more onsite user devices 118 may also be included on the drilling rig 102. The onsite user devices 118 may interact with the IT system 116. The onsite user devices 118 may include any number of user devices, for example, stationary user devices intended to be stationed at the drilling rig 102 and/or portable user devices. In some embodiments, the onsite user devices 118 may include a desktop, a laptop, a smartphone, a personal data assistant (PDA), a tablet component, a wearable computer, or other suitable devices. In some embodiments, the onsite user devices 118 may communicate with the rig computing resource environment 105 of the drilling rig 102, the remote computing resource environment 106, or both.

One or more offsite user devices 120 may also be included in the system 100. The offsite user devices 120 may include a desktop, a laptop, a smartphone, a personal data assistant (PDA), a tablet component, a wearable computer, or other suitable devices. The offsite user devices 120 may be configured to receive and/or transmit information (e.g., monitoring functionality) from and/or to the drilling rig 102 via communication with the rig computing resource environment 105. In some embodiments, the offsite user devices 120 may provide control processes for controlling operation of the various systems of the drilling rig 102. In some embodiments, the offsite user devices 120 may communicate with the remote computing resource environment 106 via the network 108.

The user devices 118 and/or 120 may be examples of a human-machine interface. These devices 118, 120 may allow feedback from the various rig subsystems to be displayed and allow commands to be entered by the user. In various embodiments, such human-machine interfaces may be onsite or offsite, or both.

The systems of the drilling rig 102 may include various sensors, actuators, and controllers (e.g., programmable logic controllers (PLCs)), which may provide feedback for use in the rig computing resource environment 105. For example, the downhole system 110 may include sensors 122, actuators 124, and controllers 126. The fluid system 112 may include sensors 128, actuators 130, and controllers 132. Additionally, the central system 114 may include sensors 134, actuators 136, and controllers 138. The sensors 122, 128, and 134 may include any suitable sensors for operation of the drilling rig 102. In some embodiments, the sensors 122, 128, and 134 may include a camera, a pressure sensor, a temperature sensor, a flow rate sensor, a vibration sensor, a current sensor, a voltage sensor, a resistance sensor, a gesture detection sensor or device, a voice actuated or recognition device or sensor, or other suitable sensors.

The sensors described above may provide sensor data feedback to the rig computing resource environment 105 (e.g., to the coordinated control device 104). For example, downhole system sensors 122 may provide sensor data 140, the fluid system sensors 128 may provide sensor data 142, and the central system sensors 134 may provide sensor data 144. The sensor data 140, 142, and 144 may include, for example, equipment operation status (e.g., on or off, up or down, set or release, etc.), drilling parameters (e.g., depth, hook load, torque, etc.), auxiliary parameters (e.g., vibration data of a pump) and other suitable data. In some embodiments, the acquired sensor data may include or be associated with a timestamp (e.g., a date, time or both) indicating when the sensor data was acquired. Further, the sensor data may be aligned with a depth or other drilling parameter.

Acquiring the sensor data into the coordinated control device 104 may facilitate measurement of the same physical properties at different locations of the drilling rig 102. In some embodiments, measurement of the same physical properties may be used for measurement redundancy to enable continued operation of the well. In yet another embodiment, measurements of the same physical properties at different locations may be used for detecting equipment conditions among different physical locations. In yet another embodiment, measurements of the same physical properties using different sensors may provide information about the relative quality of each measurement, resulting in a "higher" quality measurement being used for rig control, and process applications. The variation in measurements at different locations over time may be used to determine equipment performance, system performance, scheduled maintenance due dates, and the like. Furthermore, aggregating sensor data from each subsystem into a centralized environment may enhance drilling process and efficiency. For example, slip status (e.g., in or out) may be acquired from the sensors and provided to the rig computing resource environment 105, which may be used to define a rig state for automated control. In another example, acquisition of fluid samples may be measured by a sensor and related with bit depth and time measured by other sensors. Acquisition of data from a camera sensor may facilitate detection of arrival and/or installation of materials or equipment in the drilling rig 102. The time of arrival and/or installation of materials or equipment may be used to evaluate degradation of a material, scheduled maintenance of equipment, and other evaluations.

The coordinated control device 104 may facilitate control of individual systems (e.g., the central system 114, the downhole system, or fluid system 112. etc.) at the level of each individual system. For example, in the fluid system 112, sensor data 128 may be fed into the controller 132, which may respond to control the actuators 130. However, for control operations that involve multiple systems, the control may be coordinated through the coordinated control device 104. Examples of such coordinated control operations include the control of downhole pressure during tripping. The downhole pressure may be affected by both the fluid system 112 (e.g., pump rate and choke position) and the central system 114 (e.g., tripping speed). When it is desired to maintain certain downhole pressure during tripping, the coordinated control device 104 may be used to direct the appropriate control commands. Furthermore, for mode based controllers which employ complex computation to reach a control setpoint, which are typically not implemented in the subsystem PLC controllers due to complexity and high computing power demands, the coordinated control device 104 may provide the adequate computing environment for implementing these controllers.

In some embodiments, control of the various systems of the drilling rig 102 may be provided via a multi-tier (e.g., three-tier) control system that includes a first tier of the controllers 126, 132, and 138, a second tier of the coordinated control device 104, and a third tier of the supervisory control system 107. The first tier of the controllers may be responsible for safety critical control operation, or fast loop feedback control. The second tier of the controllers may be responsible for coordinated controls of multiple equipment or subsystems, and/or responsible for complex model based controllers. The third tier of the controllers may be responsible for high level task planning, such as to command the rig system to maintain certain bottom hole pressure. In other embodiments, coordinated control may be provided by one or more controllers of one or more of the drilling rig systems 110, 112, and 114 without the use of a coordinated control device 104. In such embodiments, the rig computing resource environment 105 may provide control processes directly to these controllers for coordinated control. For example, in some embodiments, the controllers 126 and the controllers 132 may be used for coordinated control of multiple systems of the drilling rig 102.

The sensor data 140, 142, and 144 may be received by the coordinated control device 104 and used for control of the drilling rig 102 and the drilling rig systems 110, 112, and 114. In some embodiments, the sensor data 140, 142, and 144 may be encrypted to produce encrypted sensor data 146. For example, in some embodiments, the rig computing resource environment 105 may encrypt sensor data from different types of sensors and systems to produce a set of encrypted sensor data 146. Thus, the encrypted sensor data 146 may not be viewable by unauthorized user devices (either offsite or onsite user device) if such devices gain access to one or more networks of the drilling rig 102. The sensor data 140, 142, 144 may include a timestamp and an aligned drilling parameter (e.g., depth) as discussed above. The encrypted sensor data 146 may be sent to the remote computing resource environment 106 via the network 108 and stored as encrypted sensor data 148.

The rig computing resource environment 105 may provide the encrypted sensor data 148 available for viewing and processing offsite, such as via offsite user devices 120. Access to the encrypted sensor data 148 may be restricted via access control implemented in the rig computing resource environment 105. In some embodiments, the encrypted sensor data 148 may be provided in real-time to offsite user devices 120 such that offsite personnel may view real-time status of the drilling rig 102 and provide feedback based on the real-time sensor data. For example, different portions of the encrypted sensor data 146 may be sent to offsite user devices 120. In some embodiments, encrypted sensor data may be decrypted by the rig computing resource environment 105 before transmission or decrypted on an offsite user device after encrypted sensor data is received.

The offsite user device 120 may include a client (e.g., a thin client) configured to display data received from the rig computing resource environment 105 and/or the remote computing resource environment 106. For example, multiple types of thin clients (e.g., devices with display capability and minimal processing capability) may be used for certain functions or for viewing various sensor data.

The rig computing resource environment 105 may include various computing resources used for monitoring and controlling operations such as one or more computers having a processor and a memory. For example, the coordinated control device 104 may include a computer having a processor and memory for processing sensor data, storing sensor data, and issuing control commands responsive to sensor data. As noted above, the coordinated control device 104 may control various operations of the various systems of the drilling rig 102 via analysis of sensor data from one or more drilling rig systems (e.g. 110, 112, 114) to enable coordinated control between each system of the drilling rig 102. The coordinated control device 104 may execute control commands 150 for control of the various systems of the drilling rig 102 (e.g., drilling rig systems 110, 112, 114). The coordinated control device 104 may send control data determined by the execution of the control commands 150 to one or more systems of the drilling rig 102. For example, control data 152 may be sent to the downhole system 110, control data 154 may be sent to the fluid system 112, and control data 156 may be sent to the central system 114 The control data may include, for example, operator commands (e.g., turn on or off a pump, switch on or off a valve, update a physical property setpoint, etc.). In some embodiments, the coordinated control device 104 may include a fast control loop that directly obtains sensor data 140, 142, and 144 and executes, for example, a control algorithm. In some embodiments, the coordinated control device 104 may include a slow control loop that obtains data via the rig computing resource environment 105 to generate control commands.

In some embodiments, the coordinated control device 104 may intermediate between the supervisory control system 107 and the controllers 126, 132, and 138 of the systems 110, 112, and 114. For example, in such embodiments, a supervisory control system 107 may be used to control systems of the drilling rig 102. The supervisory control system 107 may include, for example, devices for entering control commands to perform operations of systems of the drilling rig 102. In some embodiments, the coordinated control device 104 may receive commands from the supervisory control system 107, process the commands according to a rule (e.g., an algorithm based upon the laws of physics for drilling operations), and/or control processes received from the rig computing resource environment 105, and provide control data to one or more systems of the drilling rig 102. In some embodiments, the supervisory control system 107 may be provided by and/or controlled by a third party. In such embodiments, the coordinated control device 104 may coordinate control between discrete supervisory control systems and the systems 110, 112, and 114 while using control commands that may be optimized from the sensor data received from the systems 110 112, and 114 and analyzed via the rig computing resource environment 105.

The rig computing resource environment 105 may include a monitoring process 141 that may use sensor data to determine information about the drilling rig 102. For example, in some embodiments, the monitoring process 141 may determine a drilling state, equipment health, system health, a maintenance schedule, or any combination thereof. Furthermore, the monitoring process 141 may monitor sensor data and determine the quality of one or a plurality of sensor data. In some embodiments, the rig computing resource environment 105 may include control processes 143 that may use the sensor data 146 to optimize drilling operations, such as, for example, the control of drilling equipment to improve drilling efficiency, equipment reliability, and the like. For example, in some embodiments the acquired sensor data may be used to derive a noise cancellation scheme to improve electromagnetic and mud pulse telemetry signal processing. The control processes 143 may be implemented via, for example, a control algorithm, a computer program, firmware, or other suitable hardware and/or software. In some embodiments, the remote computing resource environment 106 may include a control process 145 that may be provided to the rig computing resource environment 105.

The rig computing resource environment 105 may include various computing resources, such as, for example, a single computer or multiple computers. In some embodiments, the rig computing resource environment 105 may include a virtual computer system and a virtual database or other virtual structure for collected data. The virtual computer system and virtual database may include one or more resource interfaces (e.g., web interfaces) that enable the submission of application programming interface (API) calls to the various resources through a request. In addition, each of the resources may include one or more resource interfaces that enable the resources to access each other (e.g., to enable a virtual computer system of the computing resource environment to store data in or retrieve data from the database or other structure for collected data).

The virtual computer system may include a collection of computing resources configured to instantiate virtual machine instances. The virtual computing system and/or computers may provide a human-machine interface through which a user may interface with the virtual computer system via the offsite user device or, in some embodiments, the onsite user device. In some embodiments, other computer systems or computer system services may be utilized in the rig computing resource environment 105, such as a computer system or computer system service that provisions computing resources on dedicated or shared computers/servers and/or other physical devices. In some embodiments, the rig computing resource environment 105 may include a single server (in a discrete hardware component or as a virtual server) or multiple servers (e.g., web servers, application servers, or other servers). The servers may be, for example, computers arranged in any physical and/or virtual configuration.

In some embodiments, the rig computing resource environment 105 may include a database that may be a collection of computing resources that run one or more data collections. Such data collections may be operated and managed by utilizing API calls. The data collections, such as sensor data, may be made available to other resources in the rig computing resource environment or to user devices (e.g., onsite user device 118 and/or offsite user device 120) accessing the rig computing resource environment 105. In some embodiments, the remote computing resource environment 106 may include similar computing resources to those described above, such as a single computer or multiple computers (in discrete hardware components or virtual computer systems).

Rotating Control Device (RCD) Bearing Assembly Landing in a RCD Housing

Figure 3:
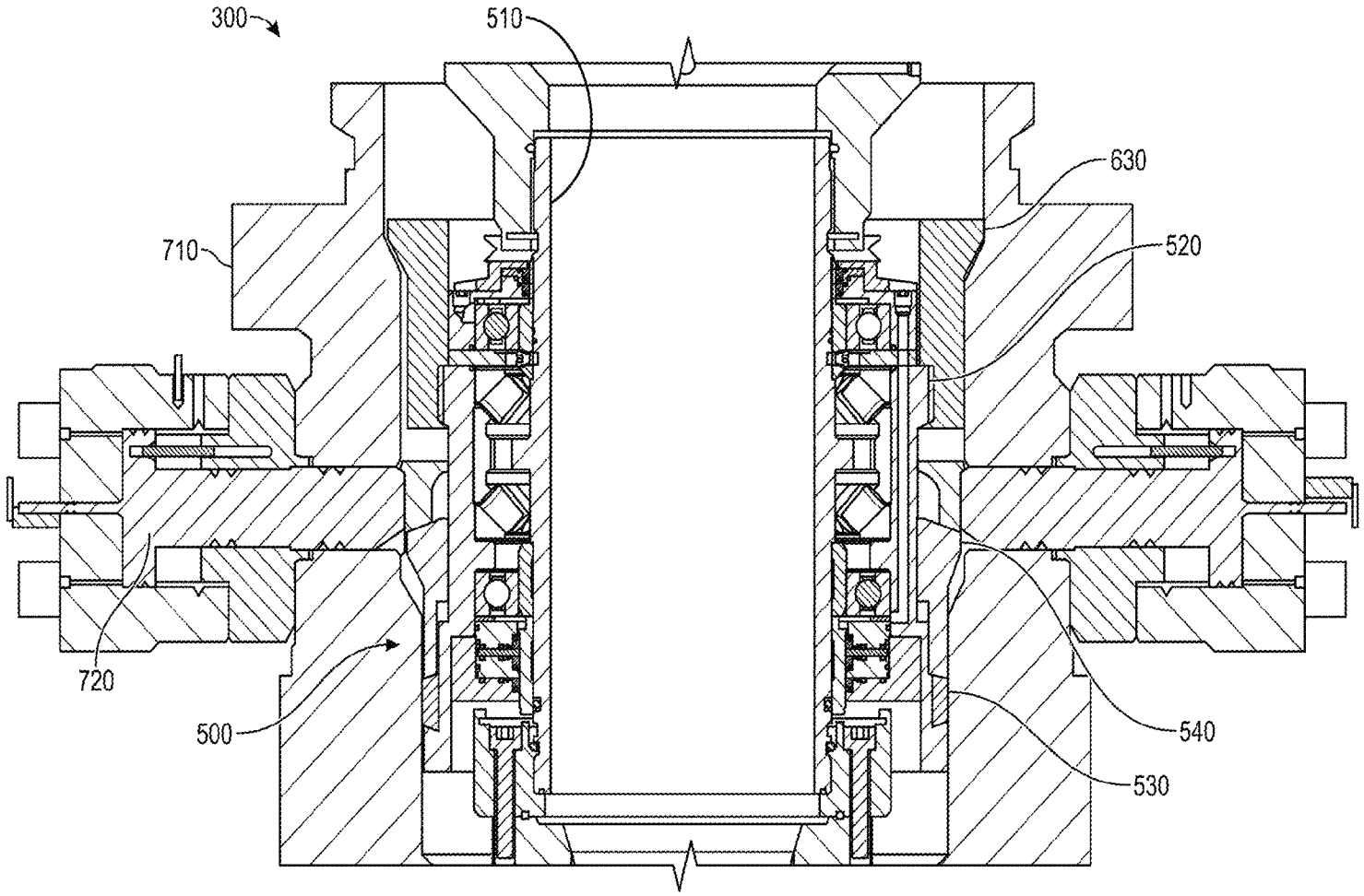
FIG. 3 illustrates a cross-sectional side view of a portion of a rotating control device (RCD), according to an embodiment.

FIG. 3 illustrates a cross-sectional side view of a portion of a rotating control device (RCD) 300, according to an embodiment. The RCD 300 may include a bearing assembly 500. The bearing assembly 500 may include a bearing body 510. The bearing body 510 may be or include a tubular member that defines a (e.g., vertical) bore therethrough.

The bearing assembly 500 may also include a bearing housing (also referred to as a bearing pack housing) 520. The bearing housing 520 may be positioned at least partially around the bearing body 510. A lower end of the bearing housing 520 may include a bearing shoulder that extends radially-outward. An upper surface of the bearing shoulder may be tapered. For example, the upper surface may taper upward proceeding radially-outward.

The bearing assembly 500 may also include a seal (also referred to as a packer seal) 530. The seal 530 may be or include an elastomeric member (e.g., an O-ring). The seal 530 may be positioned at least partially around the bearing body 510 and/or the bearing housing 520. More particularly, the seal 530 may be positioned at least partially on the shoulder of the bearing housing 520.

The bearing assembly 500 may also include a load ring 540. The load ring 540 may be positioned at least partially around the bearing assembly 500. More particularly, the load ring 540 may be positioned at least partially around the bearing body 510 and/or the bearing housing 520. The load ring 540 may be positioned above the seal 530. An upper surface of the load ring 540 may be tapered. For example, the upper surface may taper downward proceeding radially-outward.

The RCD 300 may also include a landing adapter 630. The landing adapter 630 may be positioned at least partially around the bearing assembly 500. More particularly, the landing adapter 630 may be positioned at least partially around the bearing body 510 and/or the bearing housing 520. The landing adapter 630 may be positioned at least partially above bearing housing 520, the seal 530, and/or the load ring 540. The landing adapter 630 may include a (e.g., tapered) adapter shoulder. More particularly, the adapter shoulder may taper upward proceeding radially-outward.

The RCD 300 may also include a RCD housing 710. The bearing assembly 500 and the landing adapter 630 may be positioned at least partially within the RCD housing 710. The RCD 300 may also include one or more pistons 720, which may extend radially-through openings in the RCD housing 710. The pistons 720 may actuate radially (e.g., toward and/or away from the bearing assembly 500). For example, the pistons 720 may actuate radially-inward toward the bearing housing 520 and/or the load ring 540. This may cause the pistons 720 to contact the upper surface of the load ring 540, which may push the load ring 540 downward toward the seal 530. The seal 530 may be (e.g., axially) compressed between the bearing housing 520 and the load ring 540, which may cause the seal to expand radially between the bearing housing 520 and the RCD housing 710. The seal 530 may prevent fluid flow between the bearing housing 520 and the RCD housing 710 when compressed and/or expanded.

The RCD housing 710 may be coupled (e.g., bolted) to the landing adapter 630. An inner surface of the RCD housing 710 may also define a (e.g., tapered) housing shoulder. More particularly, the housing shoulder may taper downward proceeding radially-inward. The adapter shoulder of the landing adapter 630 may land upon the housing shoulder of the RCD housing 710. The landing may prevent the landing adapter 630 from moving farther (e.g., downward) through the RCD housing 710.

Figure 4:
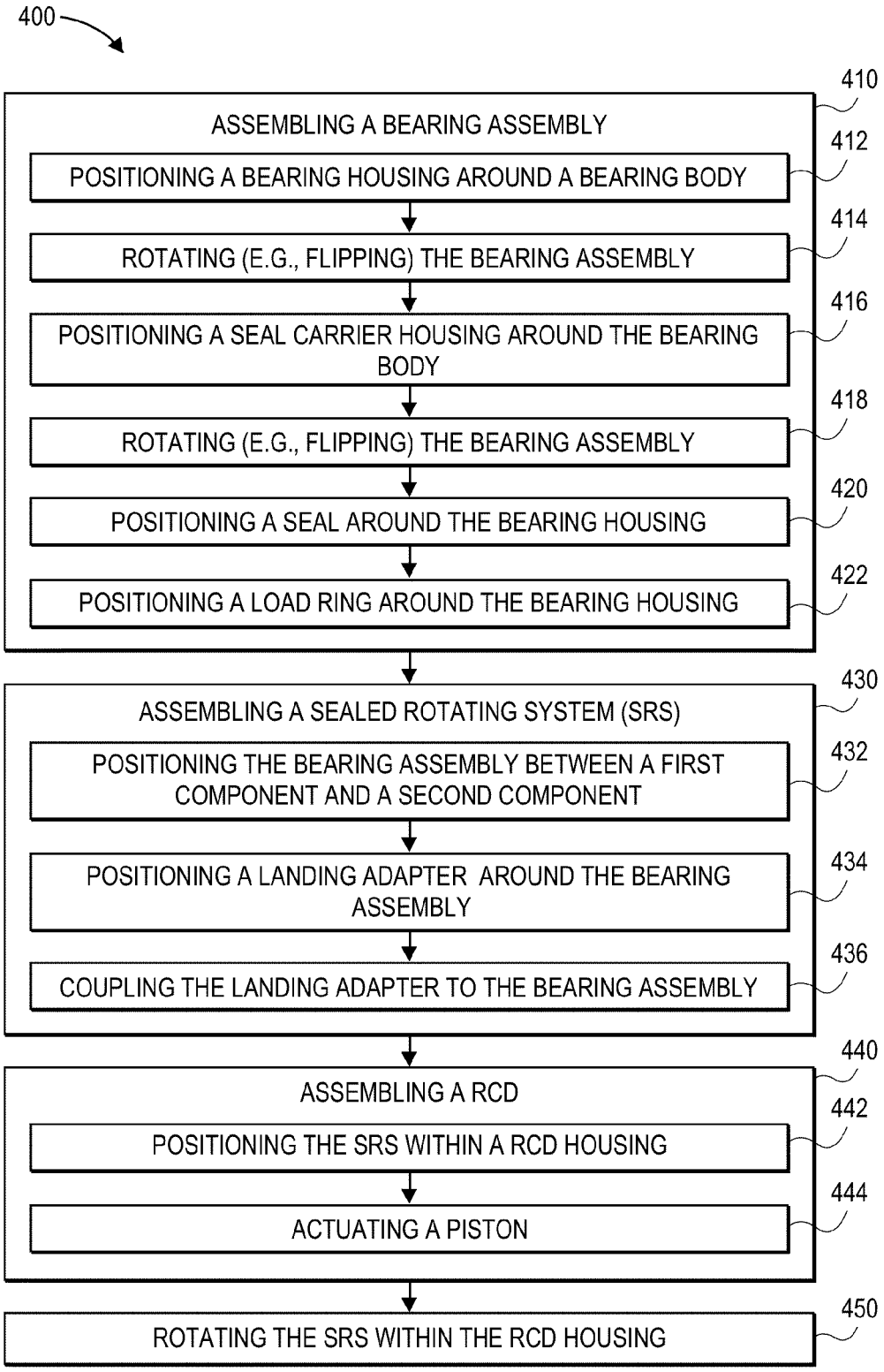
FIG. 4 illustrates a flowchart of a method for assembling the RCD, according to an embodiment.

FIG. 4 illustrates a flowchart of a method 400 for assembling the RCD 300, according to an embodiment. An illustrative order of the method 400 is provided below; however, one or more portions of the method 400 may be performed in a different order, combined, repeated or omitted.

The method 400 may include assembling the bearing assembly 500, as at 410.

Figure 5A:
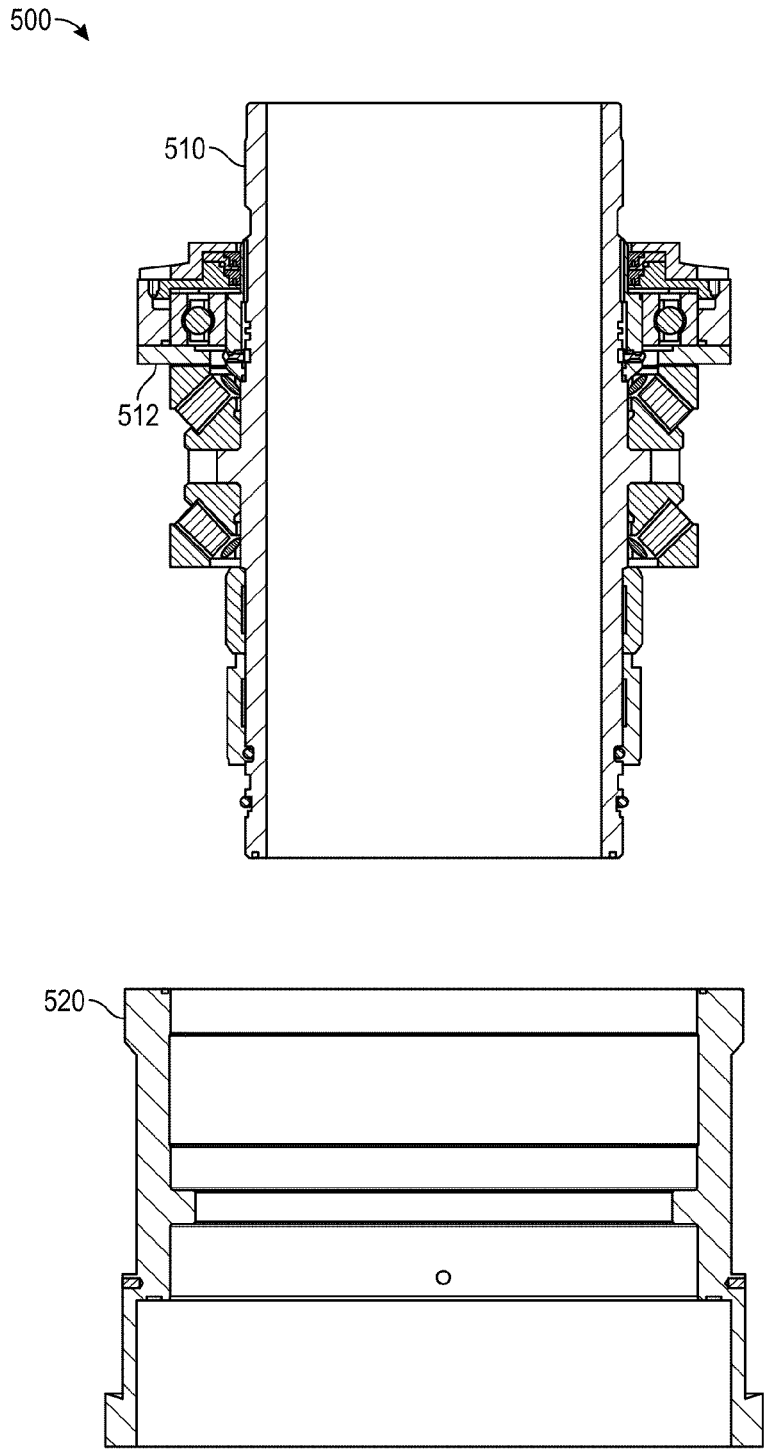
FIGS. 5A-5G illustrate cross-sectional side views of a bearing assembly that forms a part of the RCD, according to an embodiment.
Figure 5C:
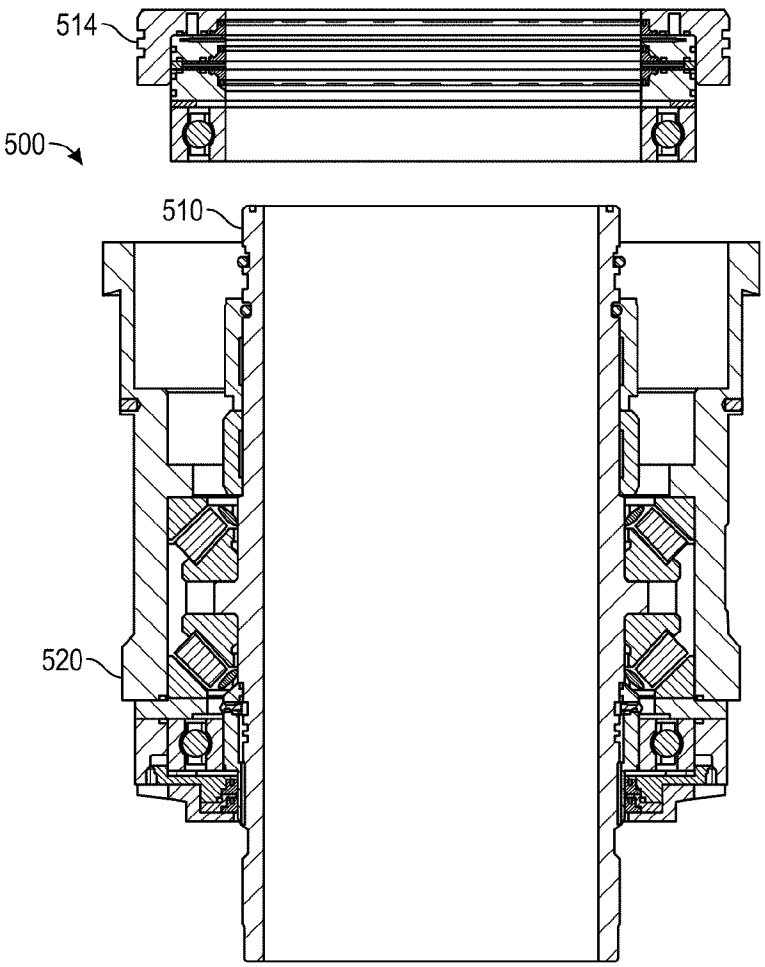
Figure 5B:
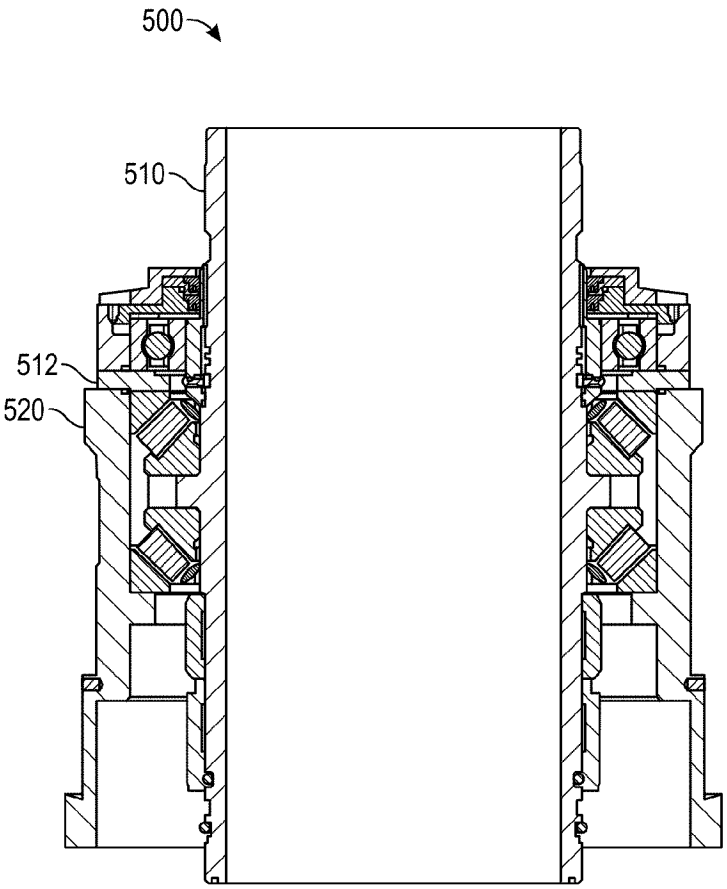

Assembling the bearing assembly 500 may include positioning the bearing housing 520 around the bearing body 510, as at 412. This is shown in FIGS. 5A and 5B. An (e.g., upper) end of the bearing housing 520 may contact a thrust plate 512 that is positioned around and/or coupled to the bearing body 510, which may prevent the bearing housing 520 from moving farther in the axial (e.g., upward) direction with respect to the bearing body 510.

Figure 5E:
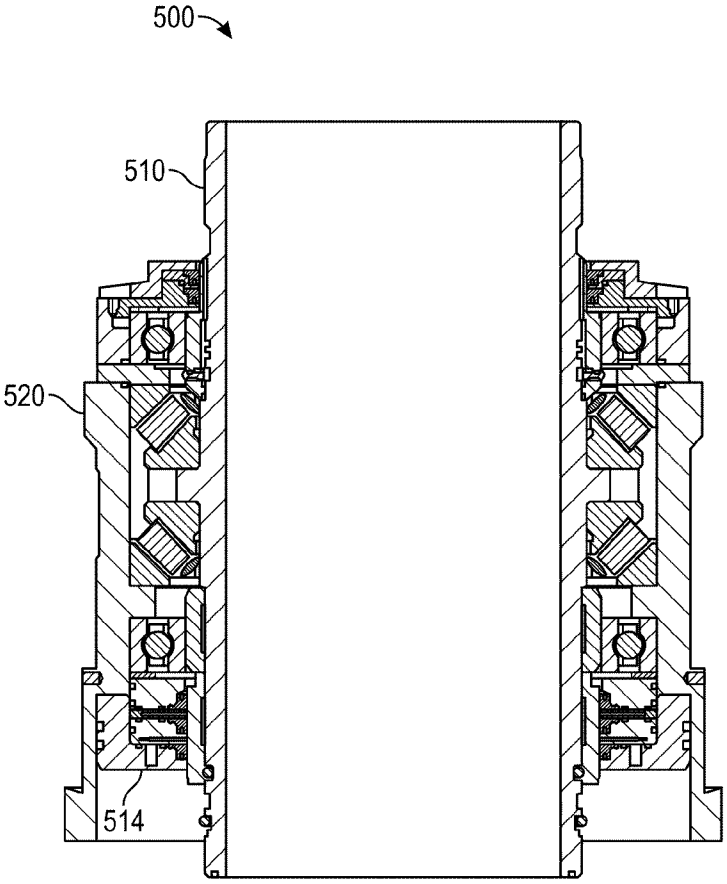
Figure 5D:
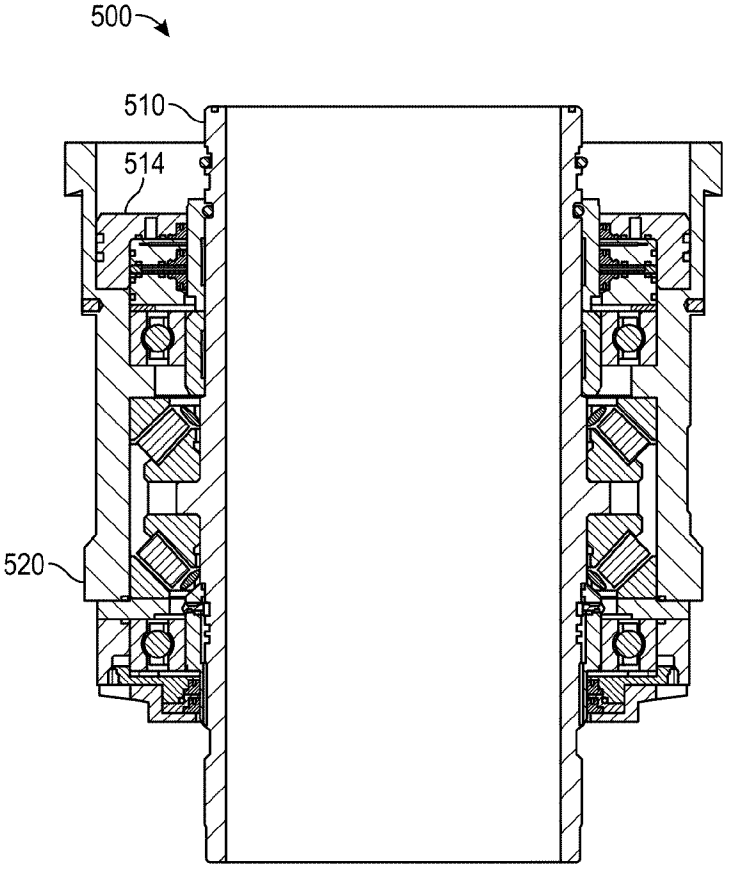

Assembling the bearing assembly 500 may also include rotating the bearing assembly 500, as at 414. More particularly, this may include flipping the bearing assembly 500 upside-down. This is shown in FIGS. 5C and 5D.

Assembling the bearing assembly 500 may also include positioning a seal carrier housing 514 around the bearing body 510, as at 416. More particularly, this may include positioning the seal carrier housing 514 at least partially into an annulus formed (e.g., radially) between the bearing body 510 and the bearing housing 520. This is shown in FIGS. 5C and 5D.

Assembling the bearing assembly 500 may also include rotating the bearing assembly 500 (again), as at 418. More particularly, this may include flipping the bearing assembly 500 right-side-up. This is shown in FIG. 5E.

Figure 5G:
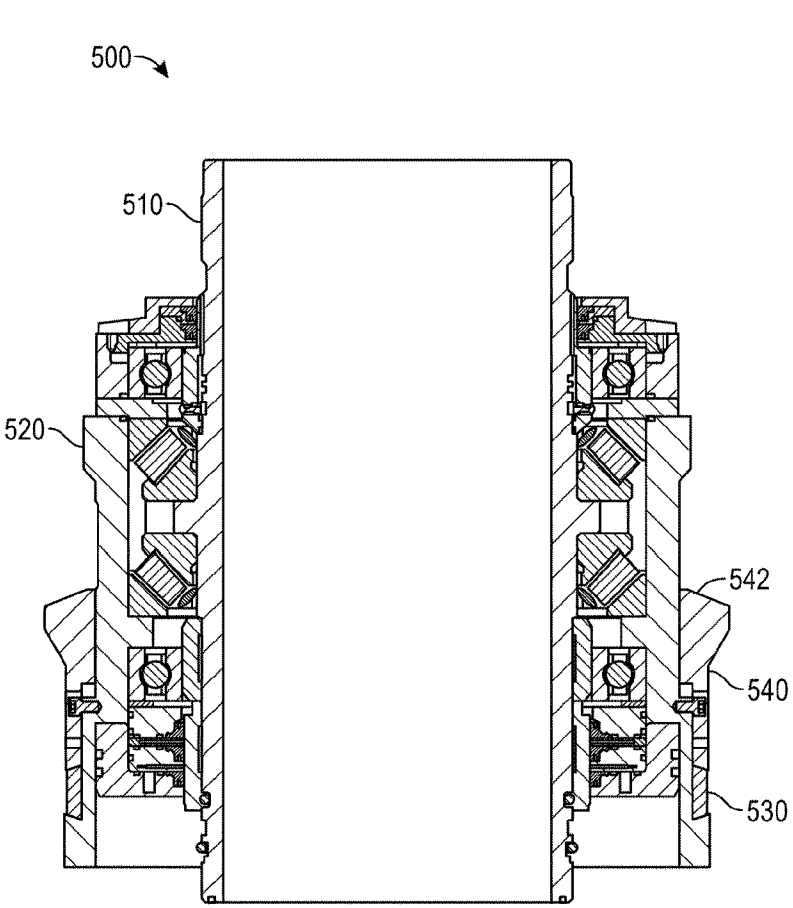
Figure 5F:
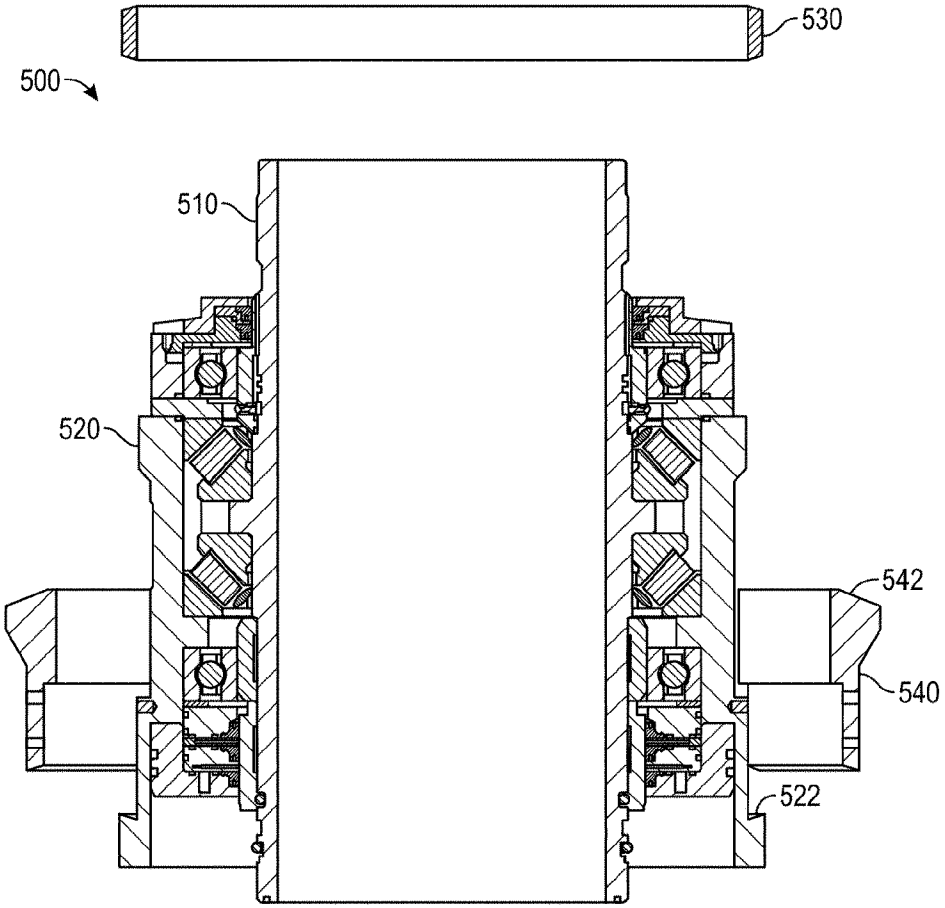

Assembling the bearing assembly 500 may also include positioning the seal 530 at least partially around the bearing housing 520, as at 420. This is shown in FIGS. 5F and 5G. As mentioned above, a lower end of the bearing housing 520 may include a (e.g., tapered) bearing shoulder 522. More particularly, the upper surface of the bearing shoulder 522 may taper upward proceeding radially-outward. The seal 530 may be positioned on (i.e., in contact with) the housing shoulder 522.

Assembling the bearing assembly 500 may also include positioning the load ring 540 at least partially around the bearing housing 520, as at 422. This is also shown in FIGS. 5F and 5G. The load ring 540 may be or include a split ring having two or more circumferential components that may be coupled together to form the annular load ring. As mentioned above, the load ring 540 may be positioned above the seal 530. A lower end of the load ring 540 may be configured to contact the seal 530. As mentioned above, an upper surface 542 of the load ring 540 may be tapered. More particularly, the upper surface 542 may taper downward proceeding radially-outward.

Figure 6A:
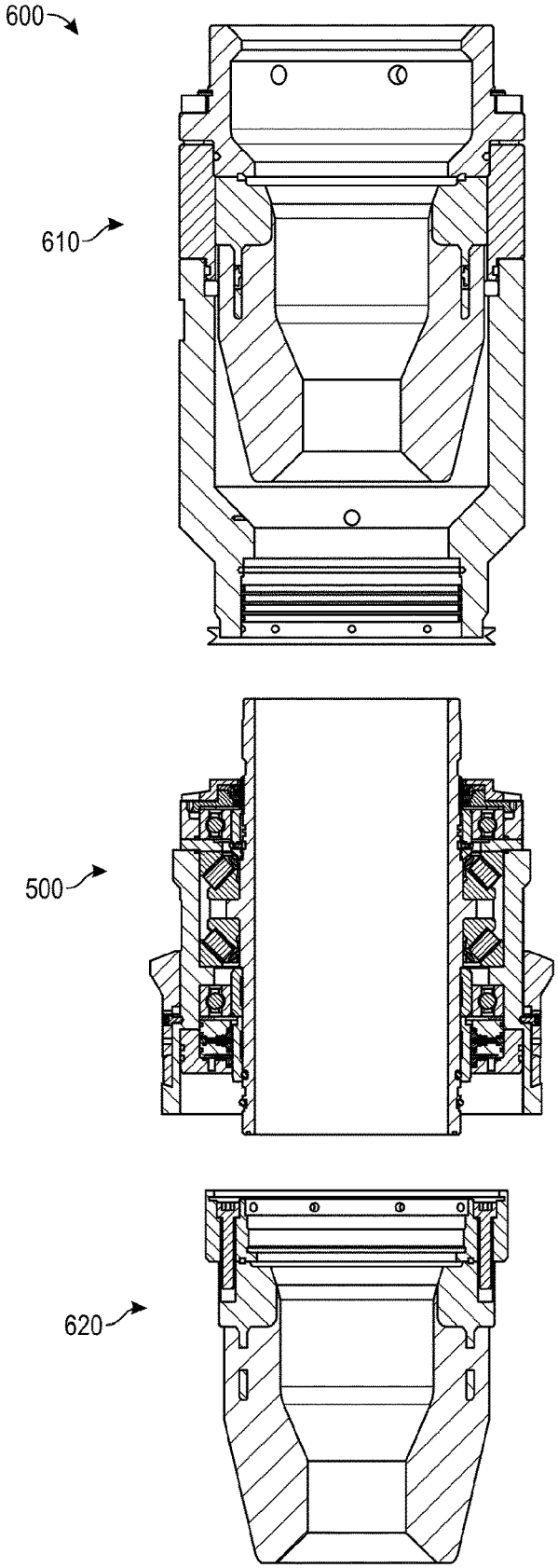
FIGS. 6A-6D illustrate cross-sectional side views of a sealed rotating system (SRS) that includes the bearing assembly and forms a part of the RCD, according to an embodiment.
Figure 6B:
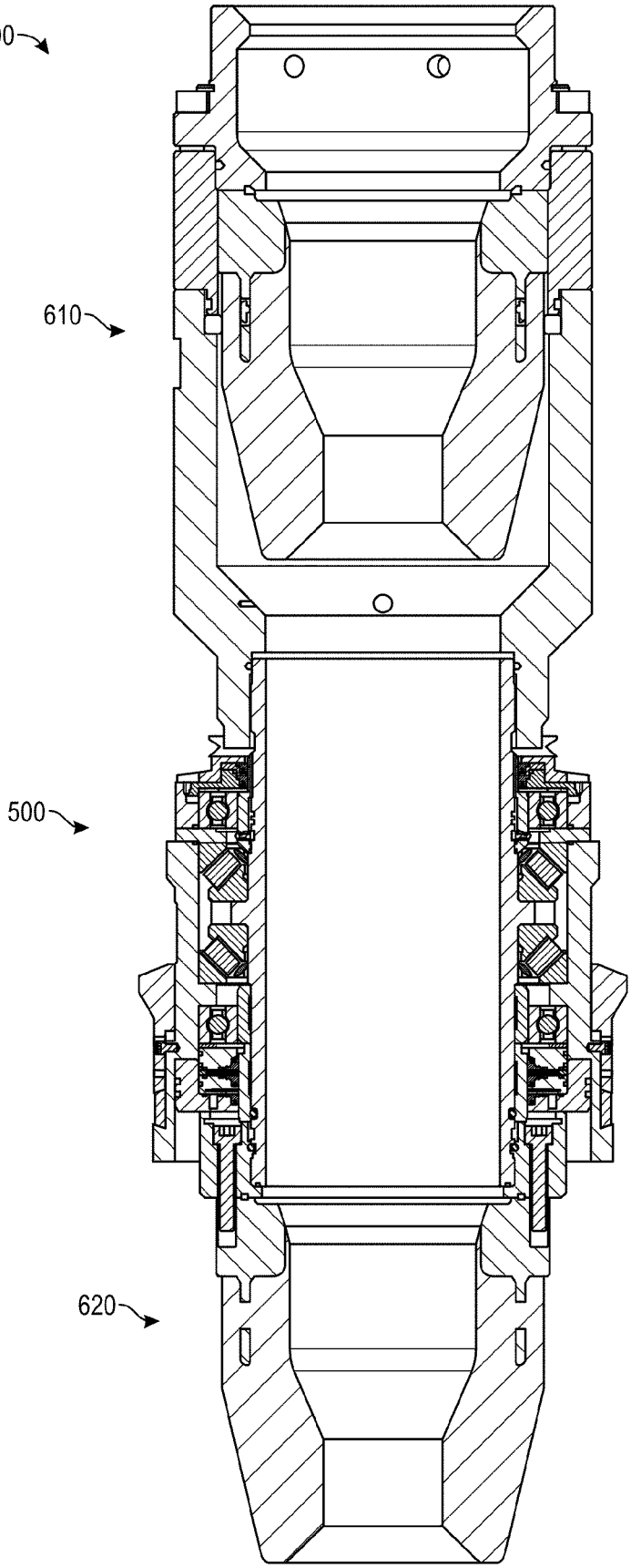

The method 400 may also include assembling a sealed rotating system (SRS) 600, as at 430. Assembling the SRS 600 may include positioning the bearing assembly 500 (e.g., vertically) between a first (e.g., upper) component 610 and a second (e.g., lower) component 620, as at 432. This is shown in FIGS. 6A and 6B. The bearing assembly 500 may be coupled (e.g., threaded) to the upper and lower components 610, 620. The upper component 610 may be or include a dual barrier assembly (DBA), and the lower component 620 may be or include a sealing element assembly. The SRS 600, the upper component 610, and the lower component 620 may be part of a drill string that is configured to rotate.

Figure 6C:
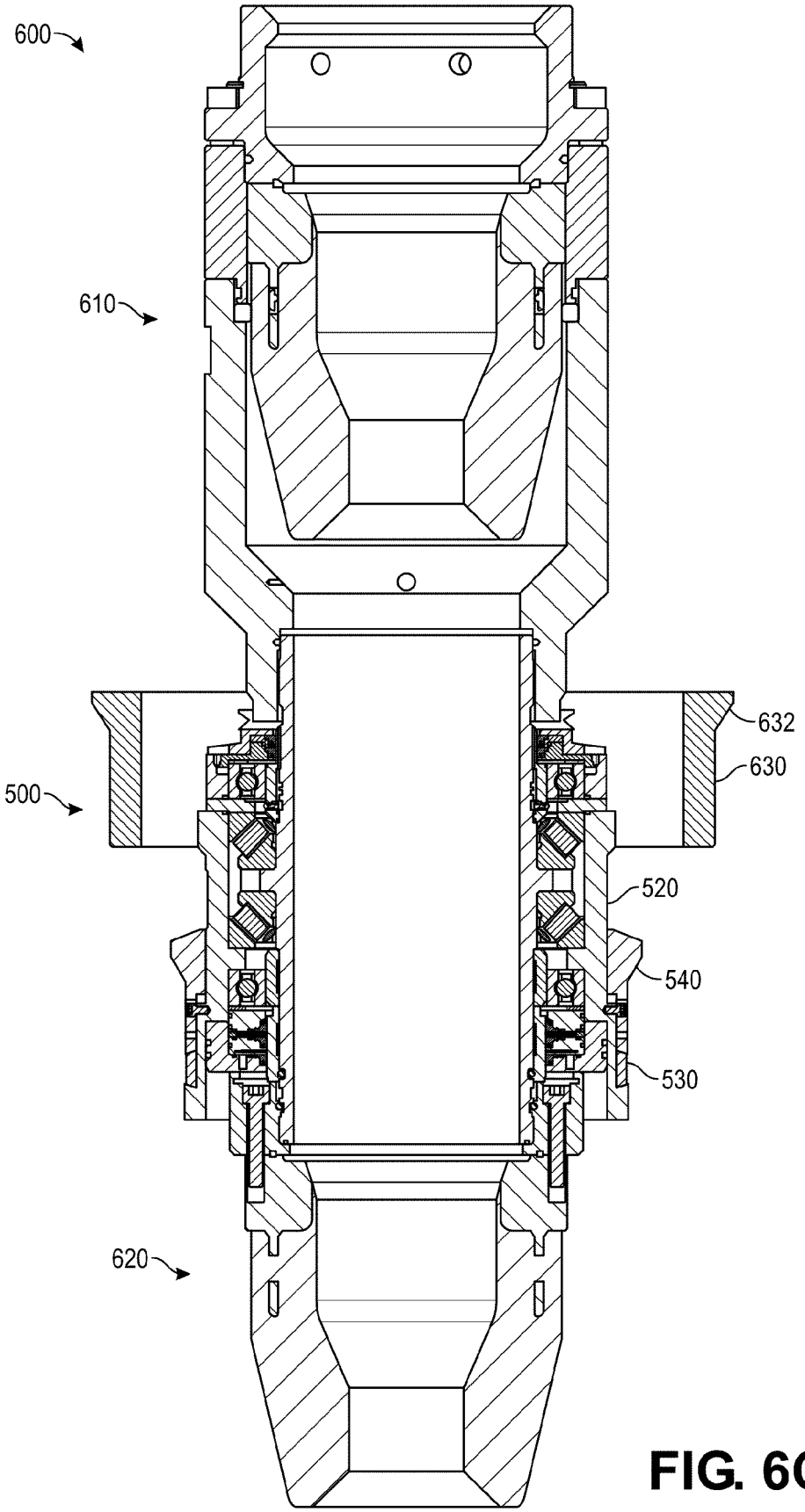
Figure 6D:
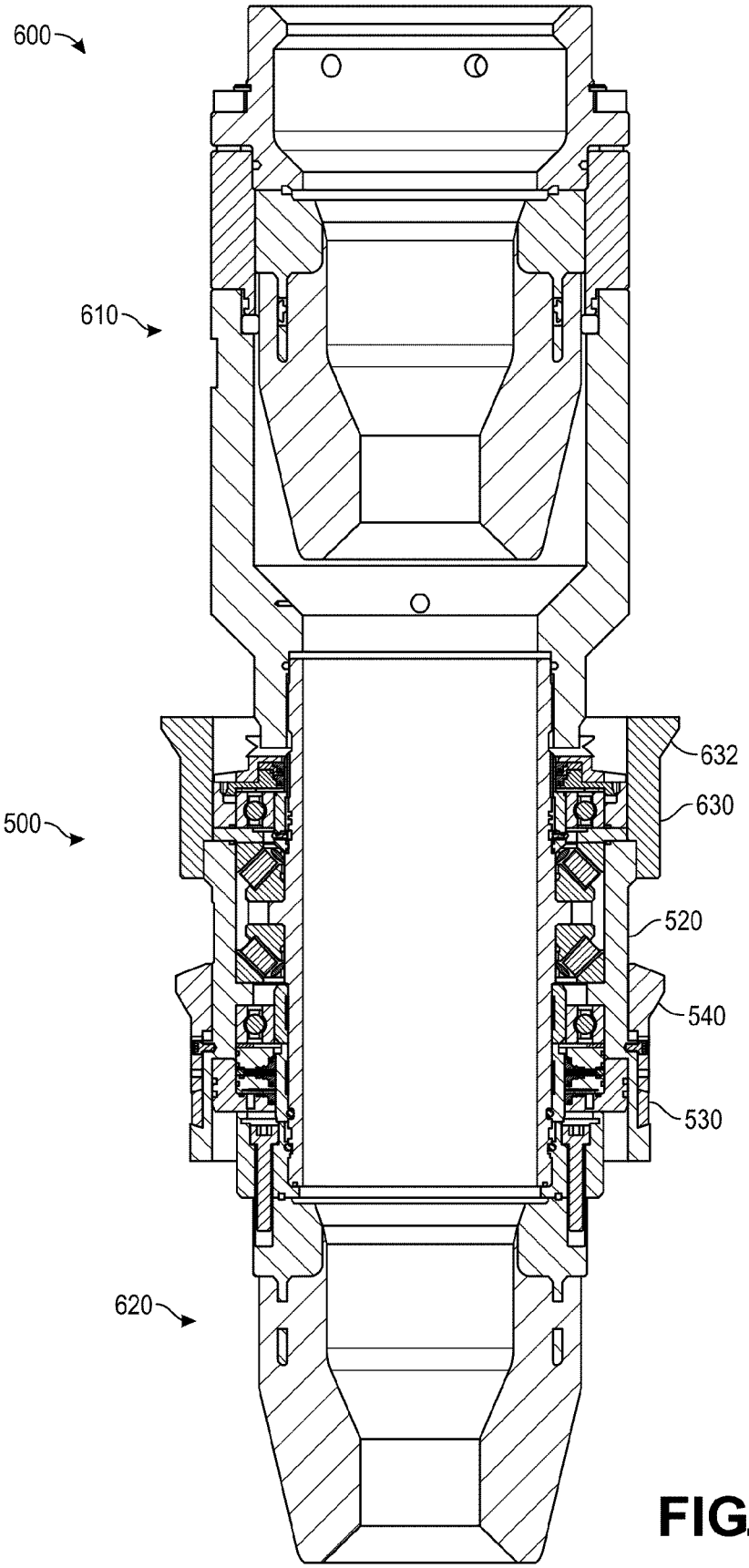

Assembling the SRS 600 may also include positioning the landing adapter 630 at least partially around the bearing assembly 500, as at 434. More particularly, the landing adapter 630 may be positioned at least partially around the bearing body 510 and/or the bearing housing 520. This is shown in FIGS. 6C and 6D. The landing adapter 630 may be or include a split ring having two or more circumferential components that may be coupled together to form the annular landing adapter. As mentioned above, the landing adapter 630 may include a (e.g., tapered) adapter shoulder 632. More particularly, the adapter shoulder 632 may taper upward proceeding radially-outward.

Assembling the SRS 600 may also include coupling the landing adapter 630 to the bearing assembly 500, as at 436. For example, the landing adapter 630 may be coupled to the bearing housing 520 using a fastening mechanism (e.g., a horizontally-oriented bolt).

Once the SRS 600 is assembled, it may differ from a conventional SRS in several respects. For example, the SRS 600 may not include a split ring or a setting sleeve, which are part of the conventional SRS. In addition, the bearing housing 520 and the load ring 540 in the SRS 600 may differ from the corresponding components in the conventional SRS. Moreover, the SRS 600 may include the landing adapter 630, which is not present in the conventional SRS. The landing adapter 630 may be used to land the SRS 600 in the RCD housing 710, as described below.

Figure 7:
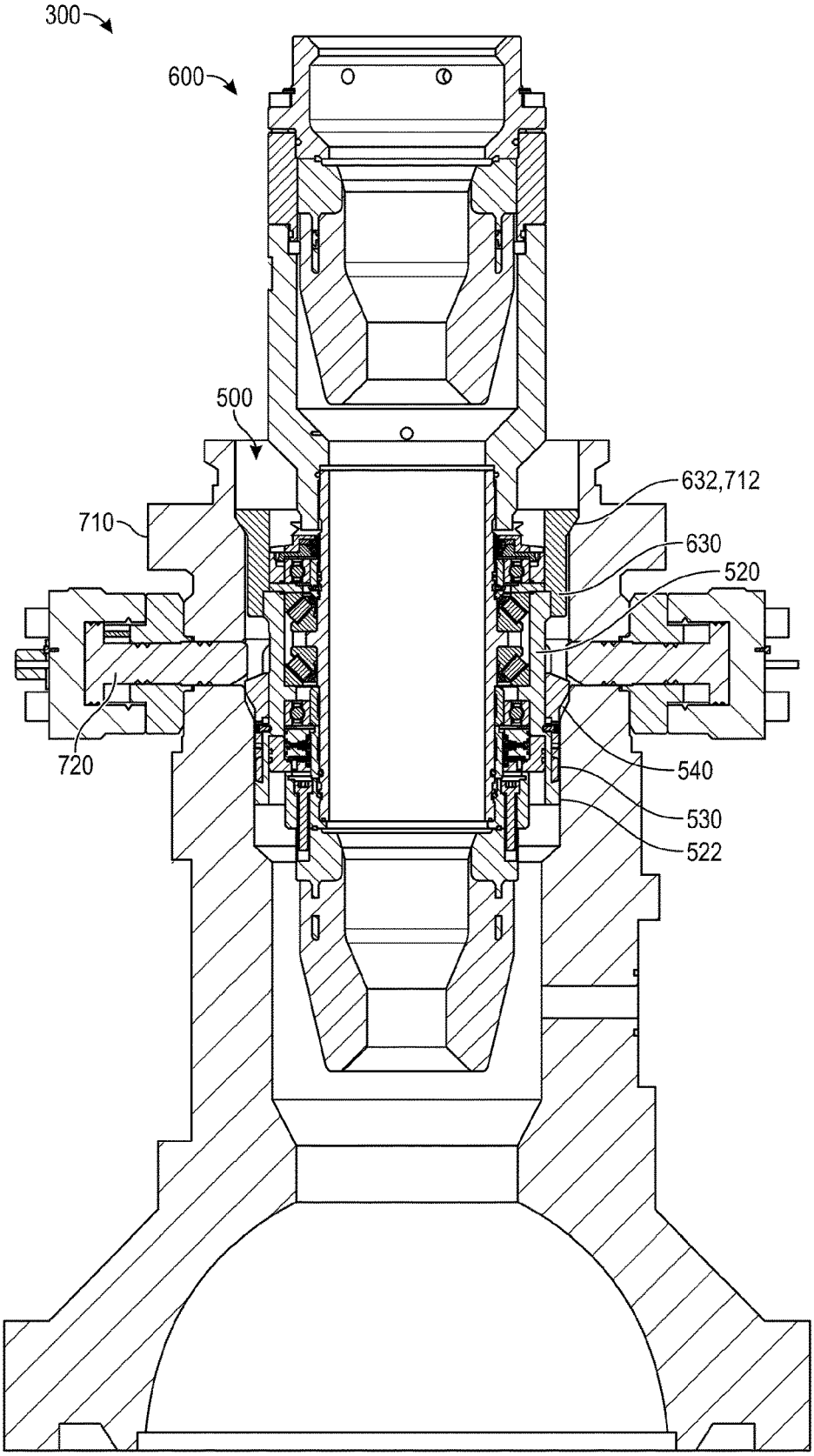
FIG. 7 illustrates cross-sectional side views of the RCD including the bearing assembly and the SRS, according to an embodiment.

The method 400 may also include assembling the RCD 300, as at 440. This is shown in FIG. 7. Assembling the RCD 300 may include positioning the SRS 600 at least partially within the RCD housing 710, as at 442. This may include landing the adapter shoulder 632 of the landing adapter 630 onto the housing shoulder 712 of the RCD housing 710. Once landed, the SRS 600 (and the bearing assembly 500 therein) are prevented from moving farther in the (e.g., downward) axial direction within the RCD housing 710.

Assembling the RCD 300 may also include actuating the pistons 720, as at 444. This may include moving the pistons 720 radially-inward through the openings in the RCD housing 710 and into contact with the upper surface 542 of the load ring 540. As mentioned above, this may push the load ring 540 downward toward the seal 530. The seal 530 may be (e.g., axially) compressed between the shoulder 522 of the bearing housing 520 and the load ring 540, which may cause the seal 530 to expand radially between the bearing housing 520 and the RCD housing 710.

As mentioned above, the SRS 600 may be part of a drill string that is configured to rotate to drill a wellbore into a subterranean formation. The method 400 may also include rotating the drill string (e.g., the SRS 600) within the RCD housing 710, as at 450. During drilling, the seal 530 may prevent fluid flow between the rotating drill string (e.g., the SRS 600) and the stationary RCD housing 710 when the seal 530 is compressed and/or expanded. This may contain hydrocarbons or other wellbore fluids and prevent their release to the atmosphere.

Once the RCD 300 is assembled, it may differ from the conventional RCD in several respects. First, the resting/landing location of the SRS 600 in the RCD housing 710 is provided by the landing adapter 630, which is located proximate to an upper end of the bearing assembly 500 and/or RCD housing 710. In contrast, the resting/landing location of the conventional RCD is located proximate to a lower end of the bearing assembly. In addition, the latching location (e.g., provided by the pistons 720) is located proximate to a middle portion of the bearing assembly 500 and/or the SRS 600. In contrast, the latching location of the conventional RCD is located above this—proximate to an upper portion of the bearing assembly and/or the SRS. Moreover, the height from the top of the RCD housing 710 to the flow port may be reduced. For example, the height may be about 35 inches compared to about 65.8 inches in the conventional RCD.

Figure 8:
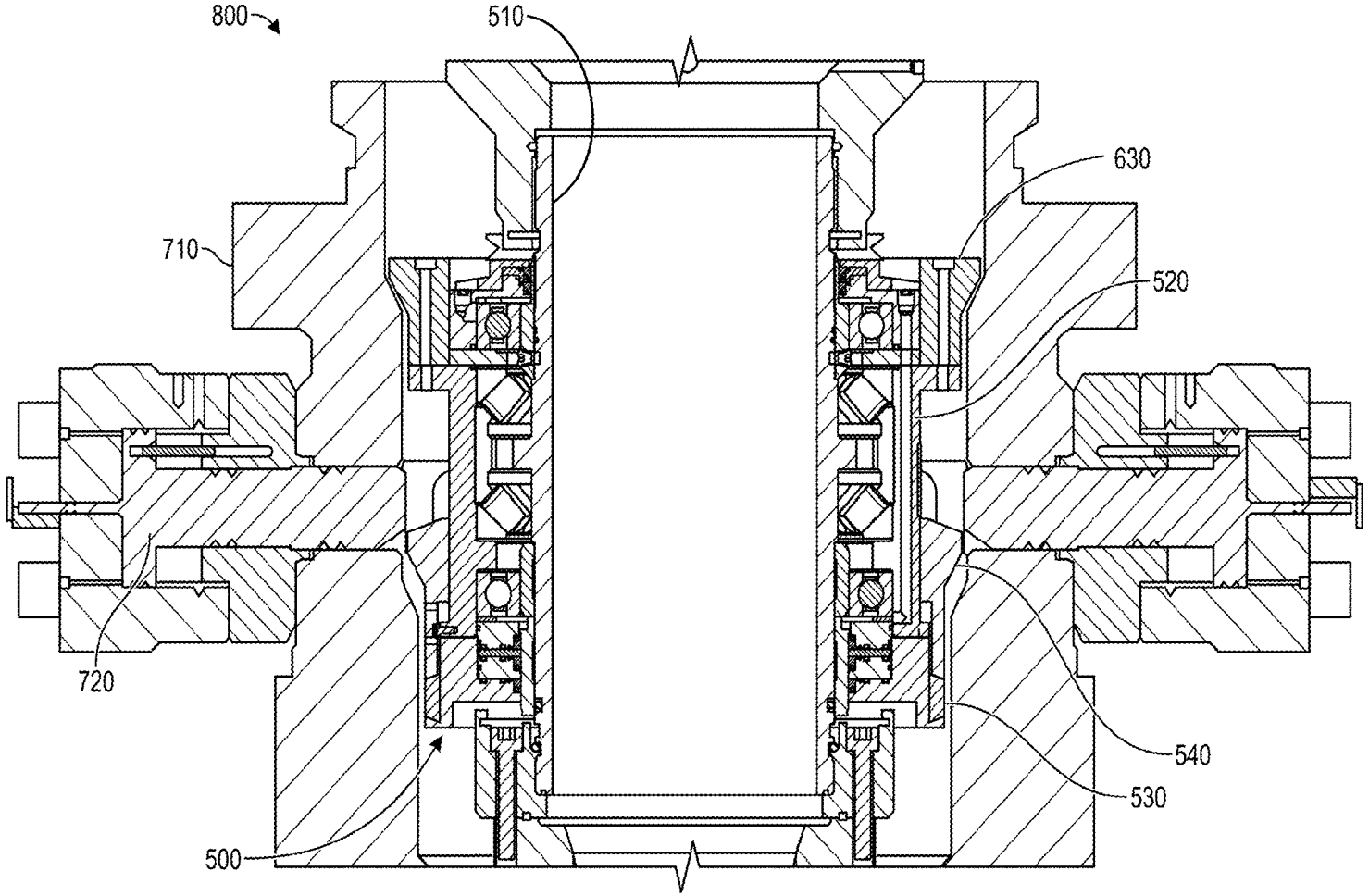
FIG. 8 illustrates a cross-sectional side view of a portion of another RCD, according to an embodiment.

FIG. 8 illustrates a cross-sectional side view of a portion of another RCD 800, according to an embodiment. The RCD 800 may be similar to the RCD 300. The RCD 800 may include the bearing assembly 500. The bearing assembly 500 may include the bearing body 510. The bearing body 510 may be or include a tubular member that defines a (e.g., vertical) bore therethrough.

The bearing assembly 500 may also include the bearing housing 520. The bearing housing 520 may be positioned at least partially around the bearing body 510. An upper end of the bearing housing 520 may include a bearing shoulder that extends radially-outward.

The bearing assembly 500 may also include the seal 530. The seal 530 may be or include an elastomeric member (e.g., an O-ring). The seal 530 may be positioned at least partially around the bearing body 510 and/or the bearing housing 520.

The bearing assembly 500 may also include the load ring 540. The load ring 540 may be positioned at least partially around the bearing assembly 500. More particularly, the load ring 540 may be positioned at least partially around the bearing body 510 and/or the bearing housing 520. The load ring 540 may be positioned above the seal 530. The upper surface of the load ring 540 may be tapered. For example, the upper surface may taper downward proceeding radially-outward.

The bearing assembly 500 may also include a seal housing (also referred to as a seal carrier housing) 550. The seal housing 550 may be positioned at least partially around the bearing body 510. The seal housing 550 may be positioned at least partially below the bearing housing 520 and the load ring 540. The seal housing 550 may include a seal housing shoulder. An upper surface of the seal housing shoulder may be tapered. For example, the upper surface may taper upward proceeding radially-outward. The seal 530 may be positioned at least partially around the seal housing 550 and land on the seal housing shoulder.

The RCD 300 may also include the landing adapter 630. The landing adapter 630 may be positioned at least partially around the bearing assembly 500. More particularly, the landing adapter 630 may be positioned at least partially around the bearing body 510. The landing adapter 630 may be positioned at least partially above bearing housing 520, the seal 530, and/or the load ring 540. The landing adapter 630 may include the (e.g., tapered) adapter shoulder. More particularly, the adapter shoulder may taper upward proceeding radially-outward.

The RCD 300 may also include the RCD housing 710. The bearing assembly 500 and the landing adapter 630 may be positioned at least partially within the RCD housing 710. The RCD 300 may also include the one or more pistons 720, which may extend radially—through openings in the RCD housing 710. The pistons 720 may actuate radially (e.g., toward and/or away from the bearing assembly 500). For example, the pistons 720 may actuate radially-inward toward the bearing housing 520 and/or the load ring 540. This may cause the pistons 720 to contact the upper surface of the load ring 540, which may push the load ring 540 downward toward the seal 530. The seal 530 may be (e.g., axially) compressed between the bearing housing 520 and the load ring 540, which may cause the seal to expand radially between the bearing housing 520 and the RCD housing 710. The seal 530 may prevent fluid flow between the bearing housing 520 and the RCD housing 710 when compressed and/or expanded.

The RCD housing 710 may be coupled (e.g., bolted) to the landing adapter 630. An inner surface of the RCD housing 710 may also define a (e.g., tapered) housing shoulder. More particularly, the housing shoulder may taper downward proceeding radially-inward. The adapter shoulder of the landing adapter 630 may land upon the housing shoulder of the RCD housing 710. The landing may prevent the landing adapter 630 from moving farther (e.g., downward) through the RCD housing 710.

Figure 9:
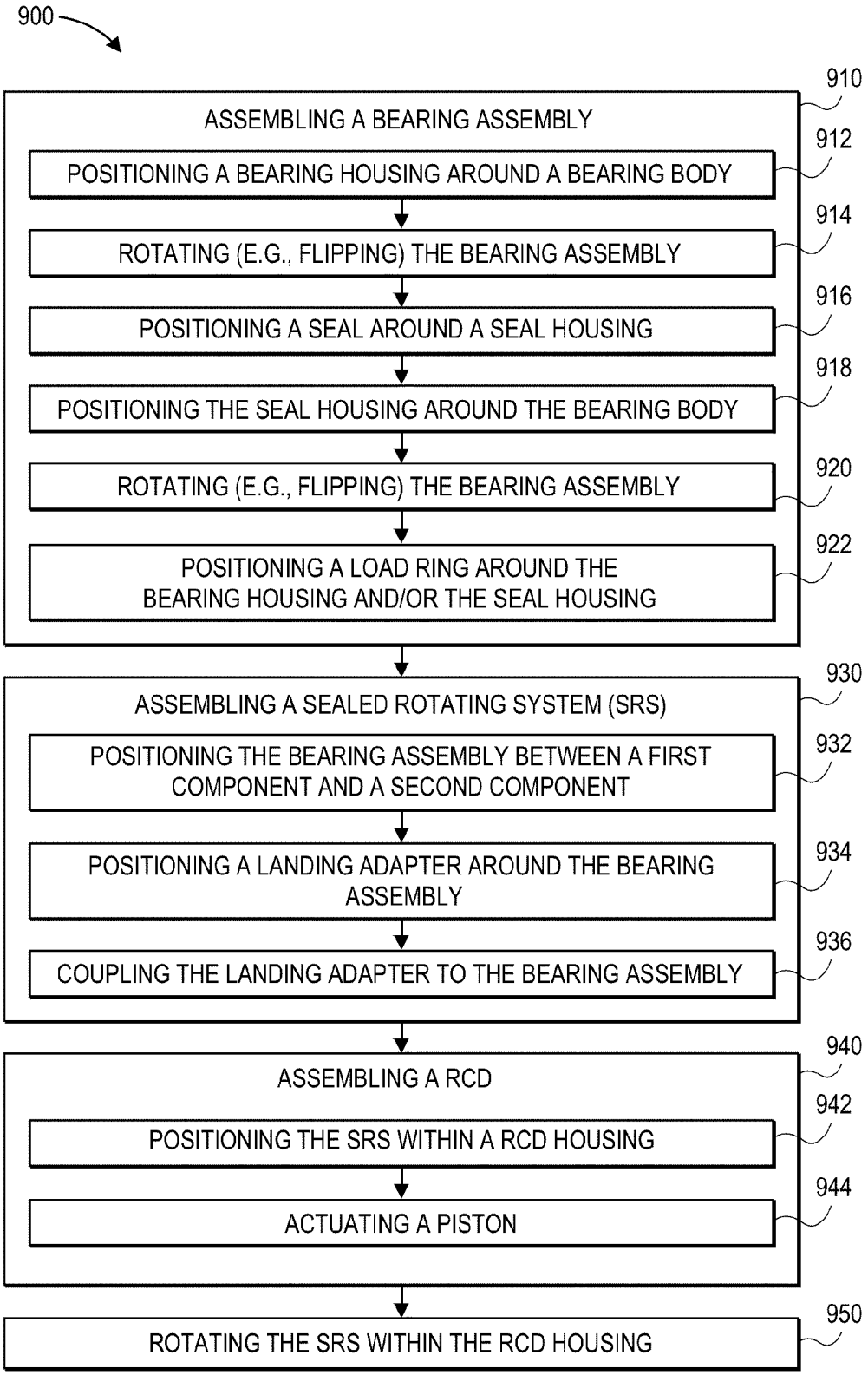
FIG. 9 illustrates a flowchart of a method for assembling the RCD in FIG. 8, according to an embodiment.

FIG. 9 illustrates a flowchart of a method 900 for assembling the RCD 800, according to an embodiment. An illustrative order of the method 900 is provided below; however, one or more portions of the method 900 may be performed in a different order, combined, repeated or omitted.

The method 900 may include assembling the bearing assembly 500, as at 910.

Figure 10B:
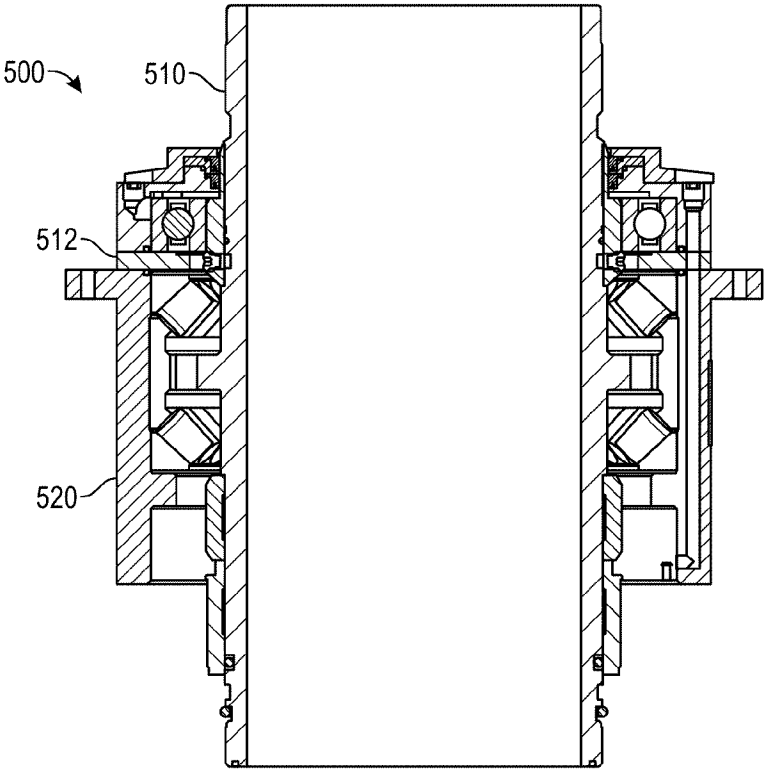
FIGS. 10A-10G illustrate cross-sectional side views of a bearing assembly that forms a part of the RCD in FIG. 8, according to an embodiment.
Figure 10A:
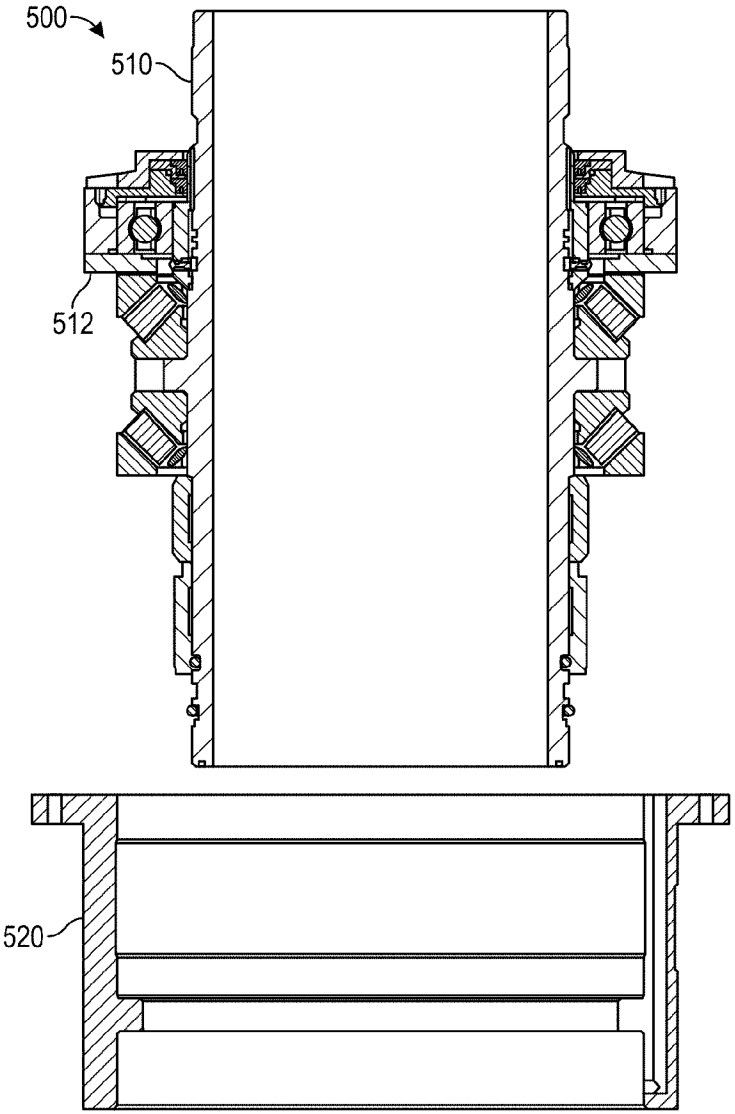

Assembling the bearing assembly 500 may include positioning the bearing housing 520 around the bearing body 510, as at 912. This is shown in FIGS. 10A and 10B. The (e.g., upper) end of the bearing housing 520 may contact a thrust plate 512 that is positioned around and/or coupled to the bearing body 510, which may prevent the bearing housing 520 from moving farther in the axial (e.g., upward) direction with respect to the bearing body 510.

Figure 10D:
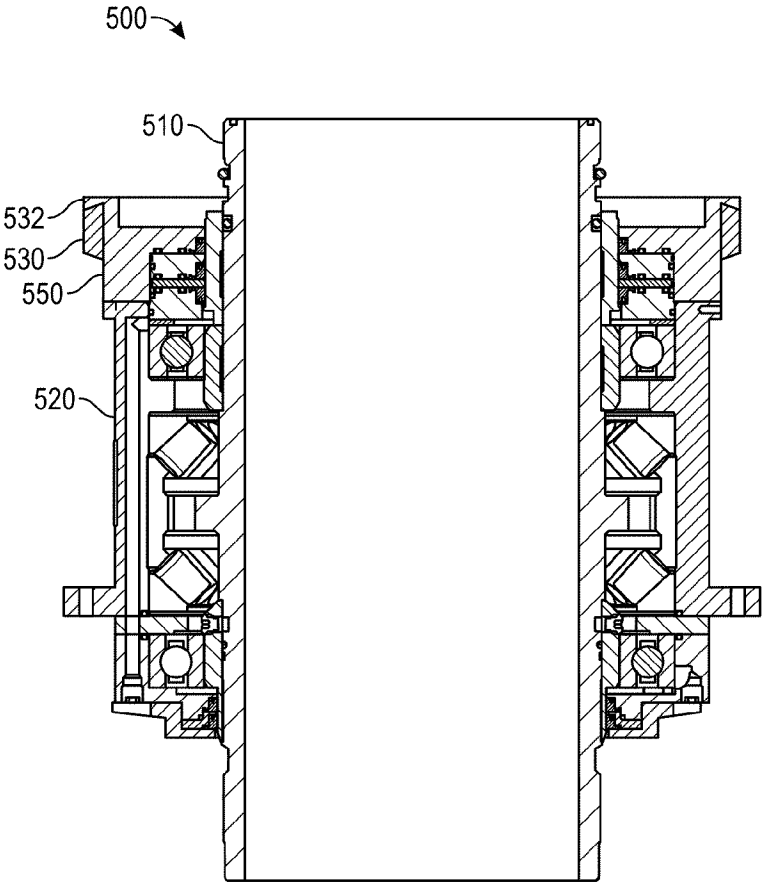
Figure 10C:
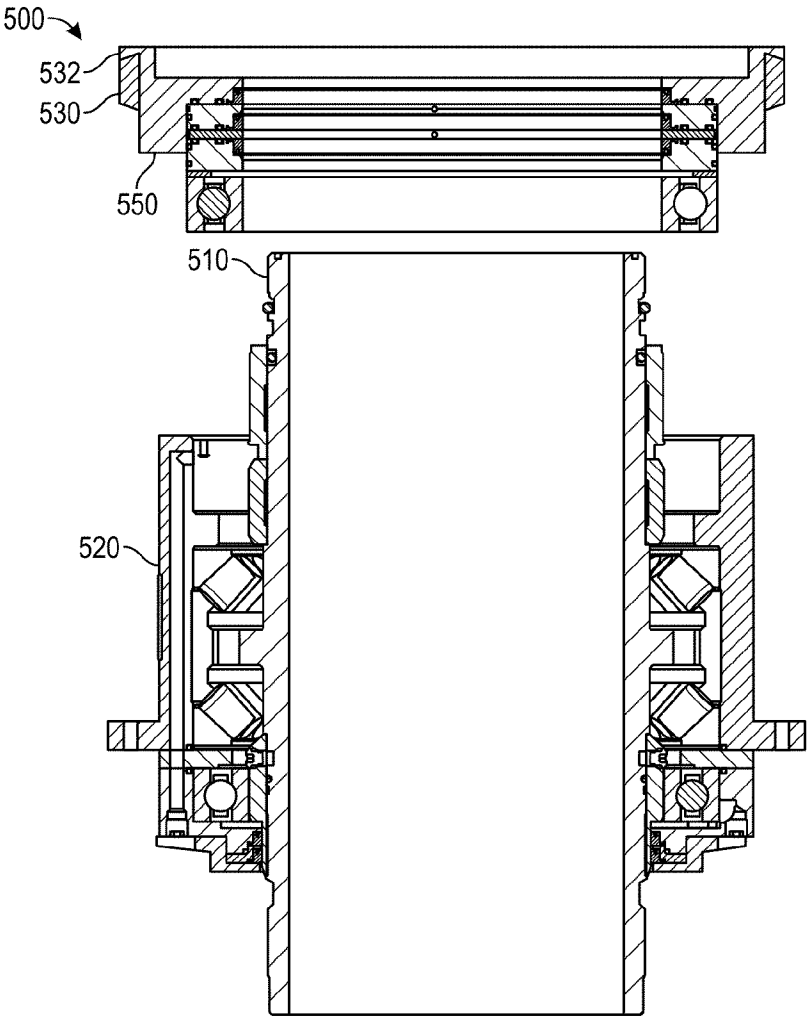

Assembling the bearing assembly 500 may also include rotating the bearing assembly 500, as at 914. More particularly, this may include flipping the bearing assembly 500 upside-down. This is shown in FIGS. 10C and 10D.

Assembling the bearing assembly 500 may also include positioning the seal 530 at least partially around the seal housing 550, as at 916. More particularly, the seal 530 may be positioned on the seal housing shoulder 532.

Assembling the bearing assembly 500 may also include positioning the seal housing 550 around the bearing body 510, as at 918. An axial end of the seal housing 550 may contact an axial end of the bearing housing 520. This is also shown in FIGS. 10C and 10D.

Figure 10F:
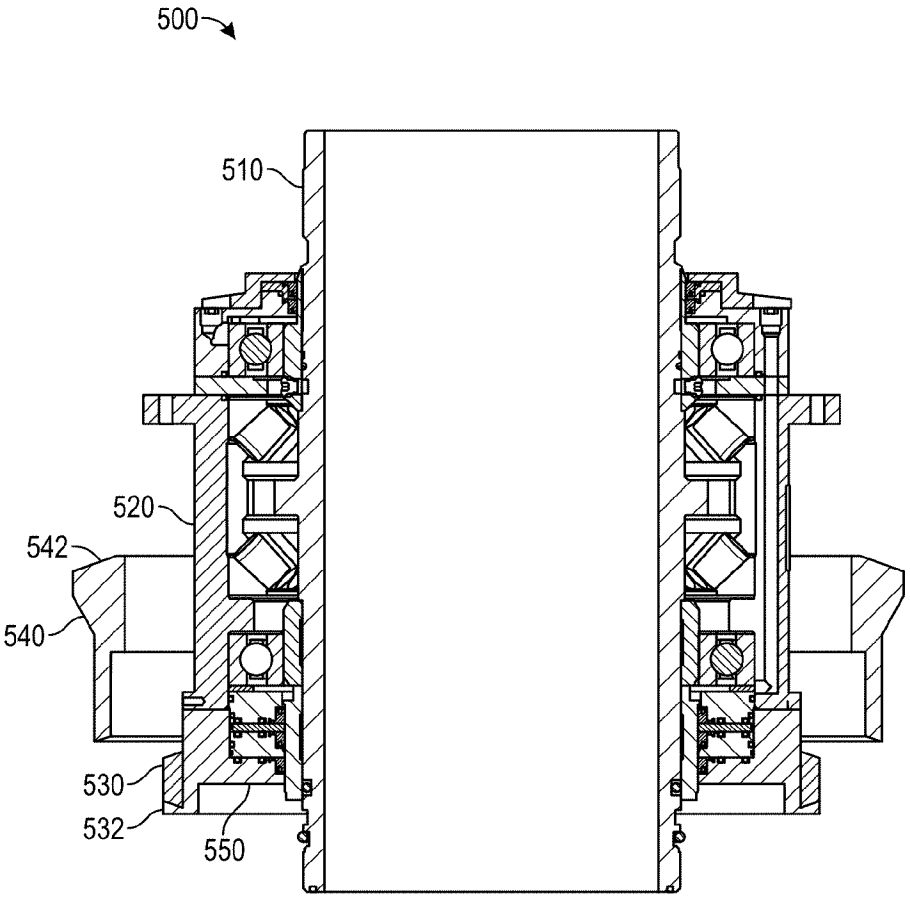
Figure 10E:
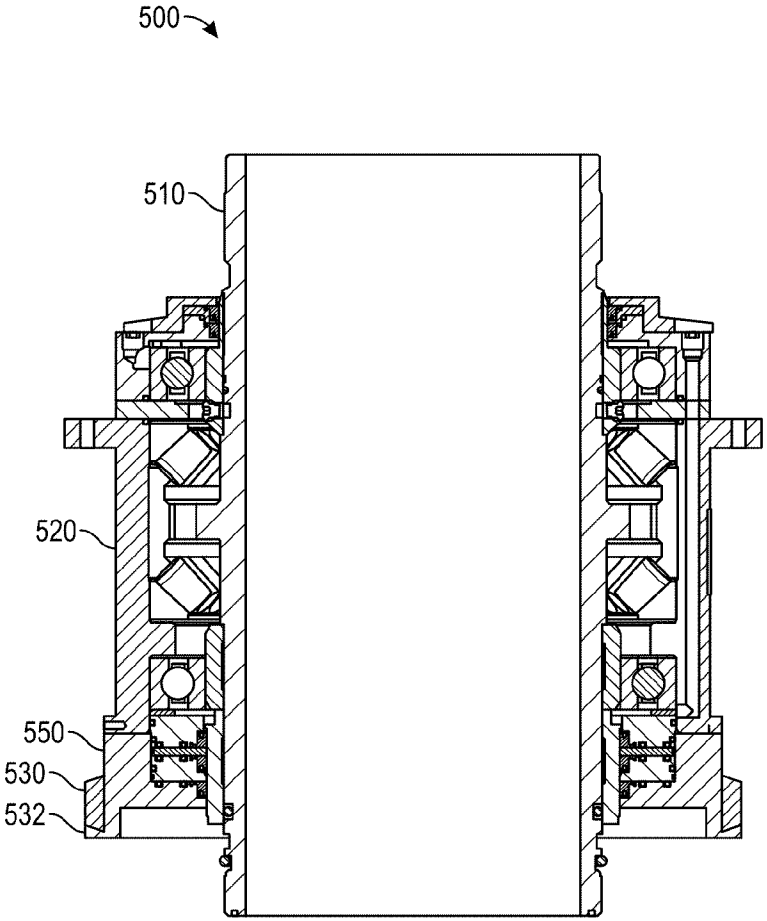

Assembling the bearing assembly 500 may also include rotating the bearing assembly 500 (again), as at 920. More particularly, this may include flipping the bearing assembly 500 right-side-up. This is shown in FIG. 10E.

Figure 10G:
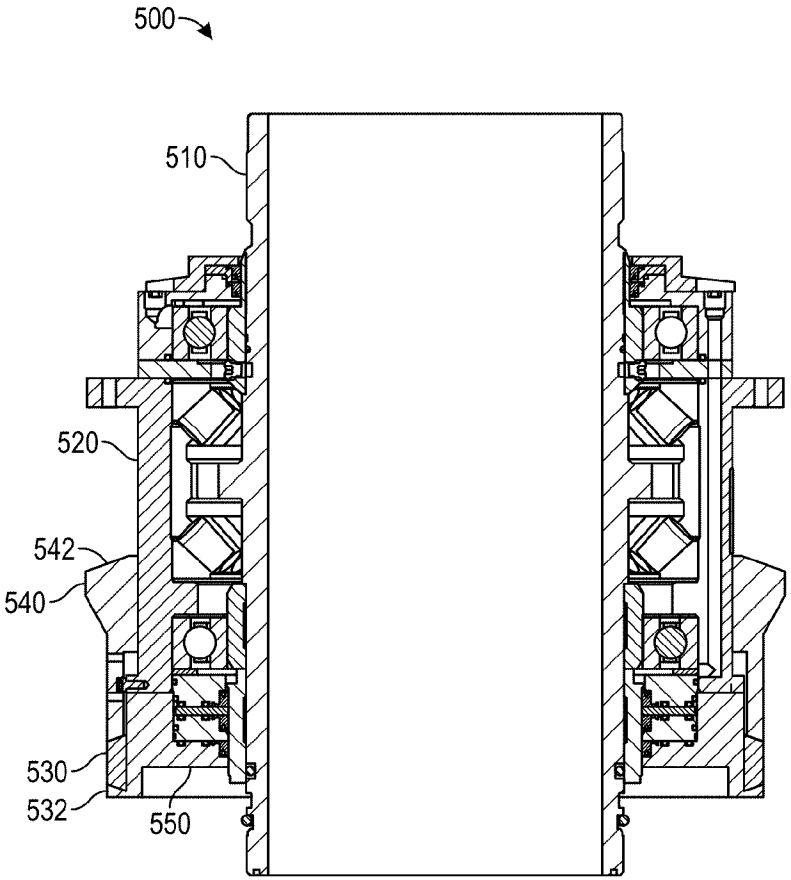

Assembling the bearing assembly 500 may also include positioning the load ring 540 at least partially around the bearing housing 520 and/or the seal housing 550, as at 922. This is shown in FIGS. 10F and 10G. The load ring 540 may be or include a split ring having two or more circumferential components that may be coupled together to form the annual load ring. As mentioned above, the load ring 540 may be positioned above the seal 530. A lower end of the load ring 540 may be configured to contact the seal 530. As mentioned above, the upper surface 542 of the load ring 540 may be tapered. More particularly, the upper surface 542 may taper downward proceeding radially-outward.

Figure 11A:
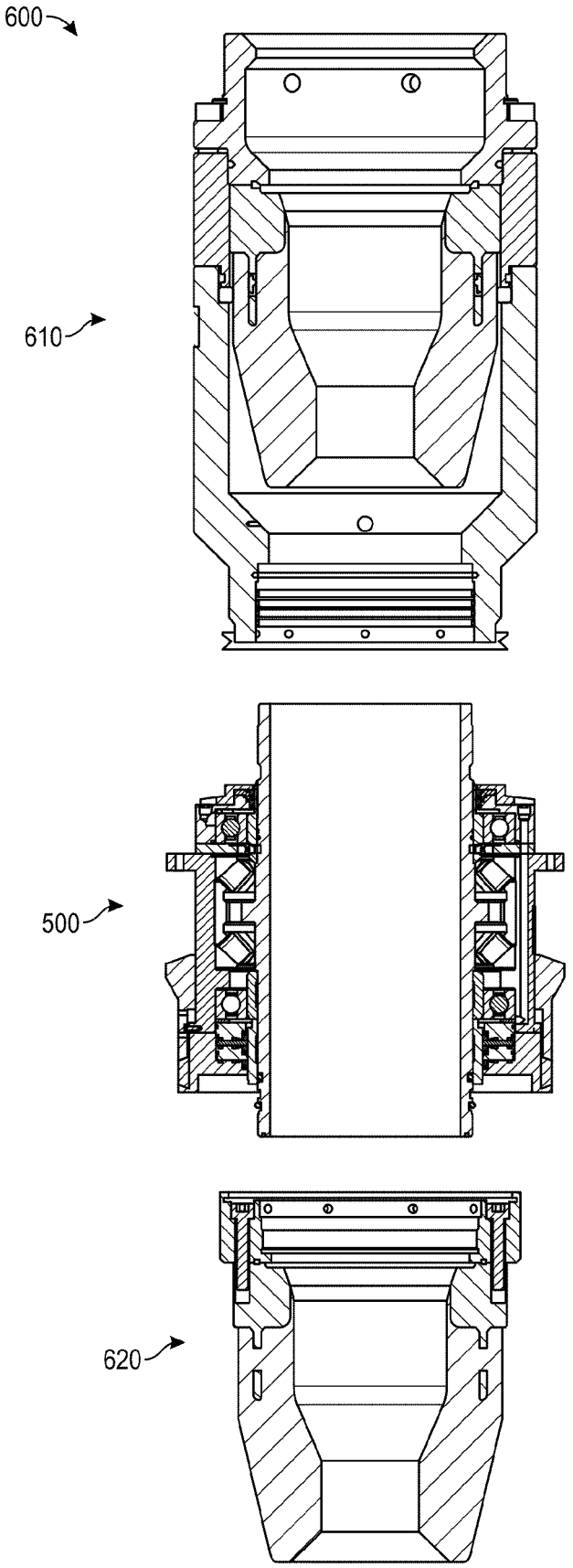
FIGS. 11A-11D illustrate cross-sectional side views of an SRS that includes the bearing assembly in FIGS. 10A-10D and forms a part of the RCD in FIG. 8, according to an embodiment.
Figure 11B:
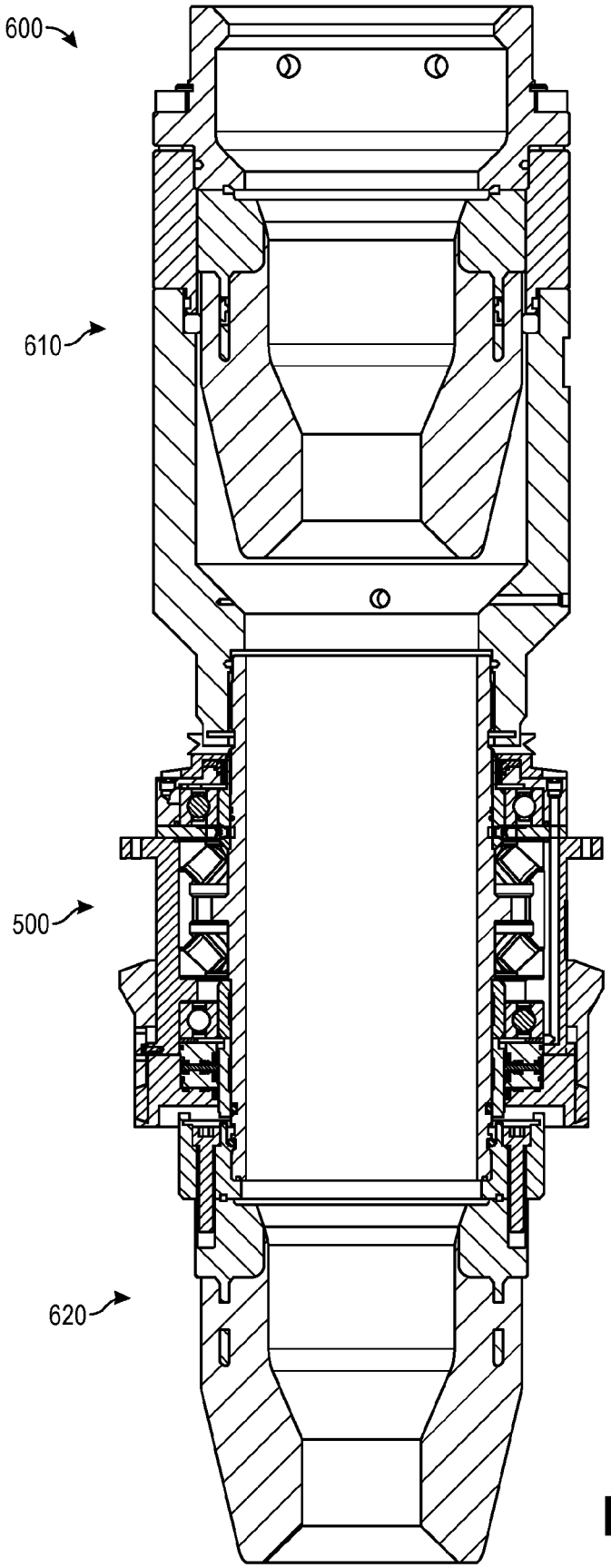

The method 900 may also include assembling the sealed rotating system (SRS) 600, as at 930. Assembling the SRS 600 may include positioning the bearing assembly 500 (e.g., vertically) between the first (e.g., upper) component 610 and the second (e.g., lower) component 620, as at 932. This is shown in FIGS. 11A and 11B. The bearing assembly 500 may be coupled (e.g., threaded) to the upper and lower components 610, 620. The upper component 610 may be or include a DBA assembly, and the lower component 620 may be or include a sealing element assembly. The SRS 600, the upper component 610, and the lower component 620 may be part of a drill string that is configured to rotate.

Figure 11C:
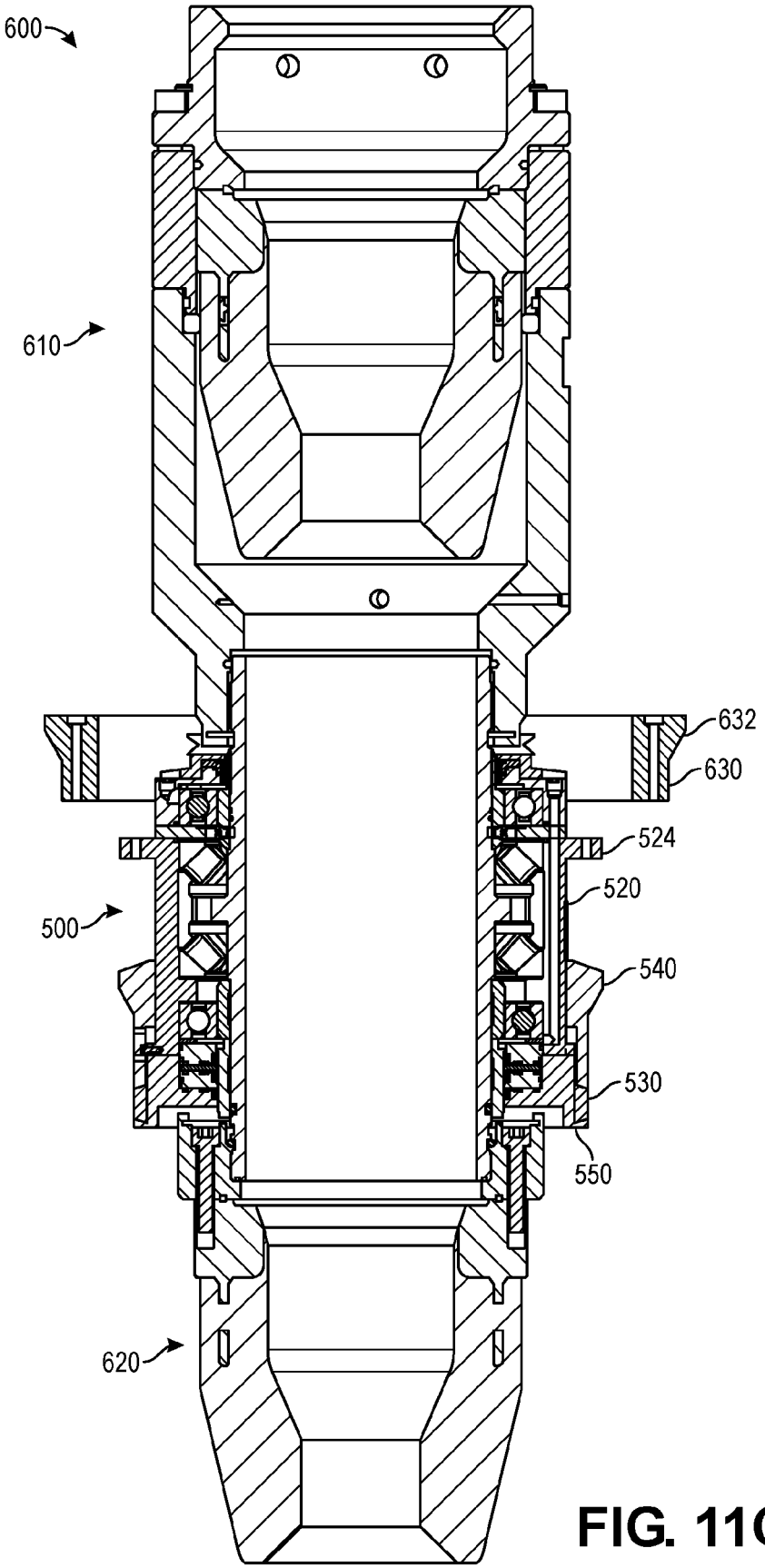
Figure 11D:
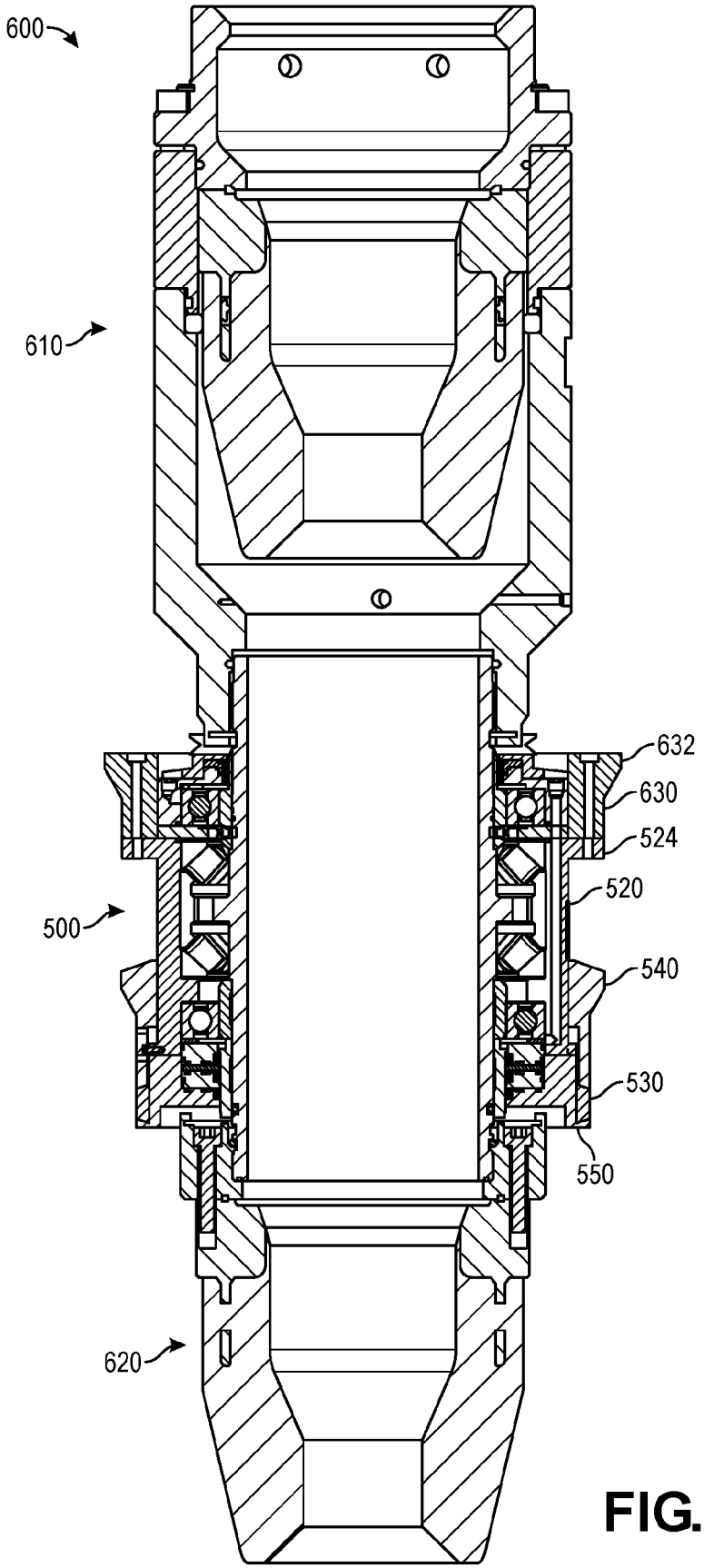

Assembling the SRS 600 may also include positioning the landing adapter 630 at least partially around the bearing assembly 500, as at 934. More particularly, the landing adapter 630 may be positioned at least partially around the bearing body 510. This is shown in FIGS. 11C and 11D. The landing adapter 630 may also be positioned at least partially above the bearing housing 520. The landing adapter 630 may contact (e.g., land upon) a shoulder 524 on the upper end of the bearing housing 520 that extends radially-outward therefrom. The landing adapter 630 may be or include a split ring having two or more circumferential components that may be coupled together to form the annular landing adapter. As mentioned above, the landing adapter 630 may include a (e.g., tapered) adapter shoulder 632. More particularly, the adapter shoulder 632 may taper upward proceeding radially-outward.

Assembling the SRS 600 may also include coupling the landing adapter 630 to the bearing assembly 500, as at 936. More particularly, the landing adapter 630 may be coupled laterally to the bearing body 510 and/or vertically to the bearing housing 520. For example, the landing adapter 630 may be coupled to the bearing housing shoulder 524 using a fastening mechanism (e.g., a vertically-oriented bolt).

Once the SRS 600 is assembled, it may differ from a conventional SRS in several respects. For example, the SRS 600 may not include a split ring or a setting sleeve, which are part of the conventional SRS. In addition, the bearing housing 520, the load ring 540, and the seal housing 550 in the SRS 600 may differ from the corresponding components in the conventional SRS. Moreover, the SRS 600 may include the landing adapter 630, which is not present in the conventional SRS. The landing adapter 630 may be used to land the SRS 600 in the RCD housing 710, as described below.

Figure 12:
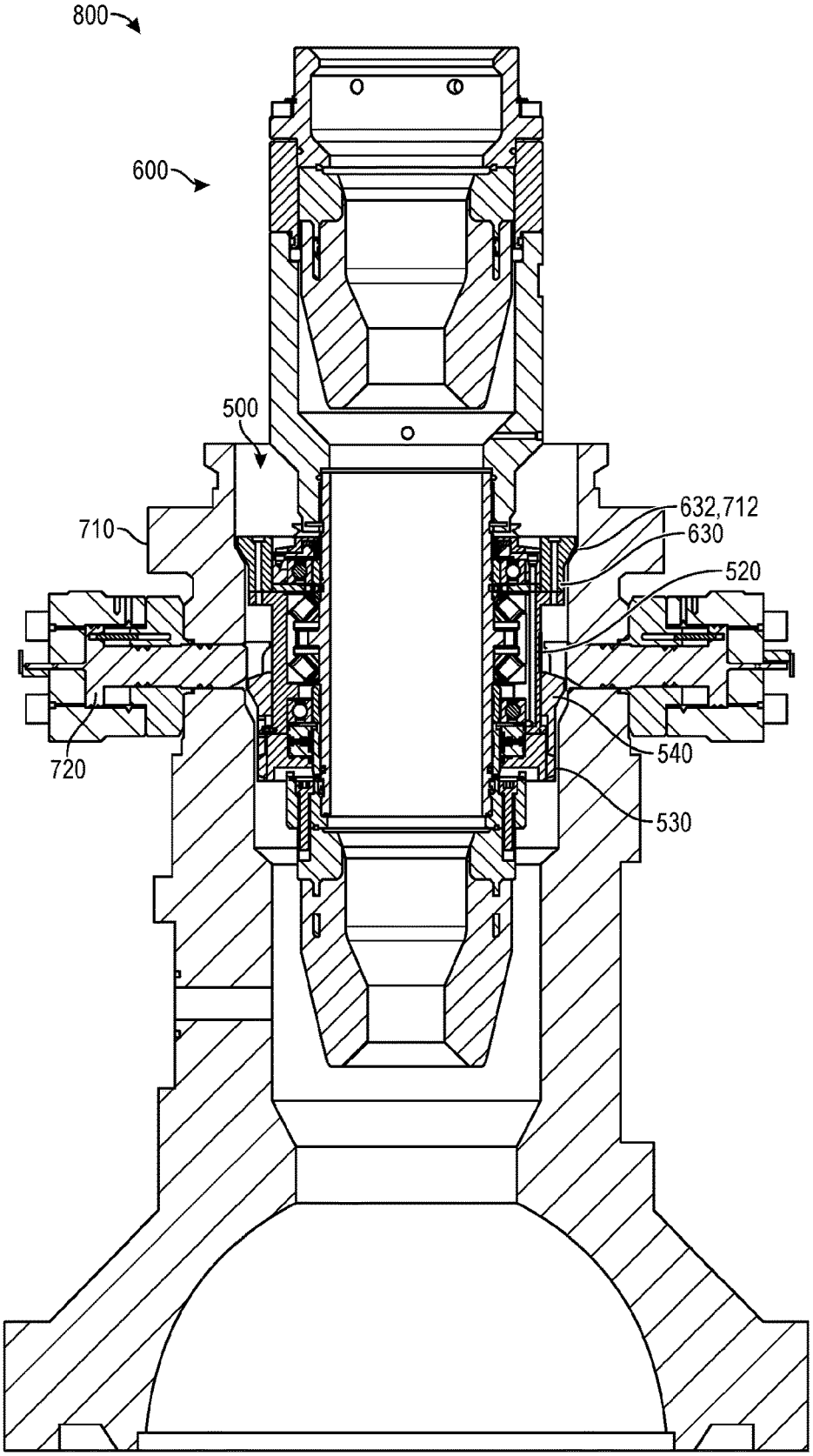
FIG. 12 illustrates cross-sectional side views of the RCD in FIG. 8 including the bearing assembly in FIGS. 10A-10G and the SRS in FIGS. 11A-11D, according to an embodiment.

The method 900 may also include assembling the RCD 800, as at 940. This is shown in FIG. 12. Assembling the RCD 800 may include positioning the SRS 600 at least partially within the RCD housing 710, as at 942. This may include landing the adapter shoulder 632 of the landing adapter 630 onto the housing shoulder 712 of the RCD housing 710. Once landed, the SRS 600 (and the bearing assembly 500 therein) are prevented from moving farther in the (e.g., downward) axial direction within the RCD housing 710.

Assembling the RCD 800 may also include actuating the pistons 720, as at 944. This may include moving the pistons 720 radially-inward through the openings in the RCD housing 710 and into contact with the upper surface 542 of the load ring 540. As mentioned above, this may push the load ring 540 downward toward the seal 530. The seal 530 may be (e.g., axially) compressed between the load ring 540 and the shoulder 532 of the seal housing 550, which may cause the seal 530 to expand radially between the bearing housing 520 and the RCD housing 710.

As mentioned above, the SRS 600 may be part of a drill string that is configured to rotate to drill a wellbore into a subterranean formation. The method 900 may also include rotating the drill string (e.g., the SRS 600) within the RCD housing 710, as at 950. During drilling, the seal 530 may prevent fluid flow between the rotating drill string (e.g., the SRS 600) and the stationary RCD housing 710 when the seal 530 is compressed and/or expanded. This may contain hydrocarbons or other wellbore fluids and prevent their release to the atmosphere.

Once the RCD 800 is assembled, it may differ from the conventional RCD in several respects. First, the resting/landing location of the SRS 600 in the RCD housing 710 is provided by the landing adapter 630, which is located proximate to an upper end of the bearing assembly 500 and/or RCD housing 710. In contrast, the resting/landing location of the conventional RCD is located proximate to a lower end of the bearing assembly. In addition, the latching location (e.g., provided by the pistons 720) is located proximate to a middle portion of the bearing assembly 500 and/or the SRS 600. In contrast, the latching location of the conventional RCD is located above this—proximate to an upper portion of the bearing assembly and/or the SRS. Moreover, the height of the RCD housing 710 may be reduced. For example, the height may be about 35 inches compared to about 65.8 inches in the conventional RCD.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to explain at least some of the principals of the disclosure and their practical applications, to thereby enable others skilled in the art to utilize the disclosed methods and systems and various embodiments with various modifications as are suited to the particular use contemplated.

What is claimed is:

1. A rotating control device (RCD) for use during a drilling operation, comprising:

a bearing assembly comprising:

a bearing body;

a bearing housing positioned around the bearing body;

a load ring positioned around the bearing housing, wherein the load ring comprises a tapered upper surface; and a seal positioned below the load ring;

a landing adapter positioned around the bearing housing, above the bearing housing, or both, wherein the landing adapter is positioned above the seal and the load ring, wherein the landing adapter is coupled to the bearing housing, and wherein the landing adapter comprises a tapered outer shoulder;

an RCD housing positioned around the bearing assembly and the landing adapter, wherein the RCD housing comprises a tapered inner shoulder, and wherein the tapered outer shoulder of the landing adapter is configured to land on the tapered inner shoulder of the RCD housing; and a piston extending radially-through an opening in the RCD housing, wherein the piston is configured to move radially-inward to contact the tapered upper surface of the load ring, which pushes the load ring downward and causes the load ring to axially-compress the seal, and wherein the seal expands radially in response to being axially-compressed to prevent fluid flow between the bearing housing and the RCD housing as the bearing assembly and the landing adapter rotate with respect to the RCD housing.

2. The RCD of claim 1, wherein the bearing housing comprises a tapered outer shoulder proximate to a lower end thereof, and wherein the seal is positioned around the bearing housing and axially-between the load ring and the tapered outer shoulder of the bearing housing.

3. The RCD of claim 1, wherein the landing adapter is coupled to the bearing housing via a horizontal fastening mechanism.

4. The RCD of claim 1, further comprising a seal housing positioned at least partially below the bearing housing and at least partially within the bearing housing, wherein the seal housing comprises a tapered outer shoulder, and wherein the seal is positioned around the seal housing and axially-between the load ring and the tapered outer shoulder of the seal housing.

5. The RCD of claim 1, wherein the bearing housing comprises an outer shoulder, wherein the landing adapter is coupled to the outer shoulder via a vertical fastening mechanism.

* * * * *